US006739927B2

(12) United States Patent
Tsuruha et al.

(10) Patent No.: US 6,739,927 B2
(45) Date of Patent: May 25, 2004

(54) METHOD OF ASSEMBLING COLOR CRT AND ASSEMBLING DEVICE

(75) Inventors: Masayuki Tsuruha, Hirakata (JP); Kenichi Satoh, Ibaraki (JP); Kazuya Aoyama, Takatsuki (JP); Osamu Hirota, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 14 days.

(21) Appl. No.: 10/220,546

(22) PCT Filed: Jan. 15, 2002

(86) PCT No.: PCT/JP02/00213

§ 371 (c)(1),
(2), (4) Date: Dec. 5, 2002

(87) PCT Pub. No.: WO02/058094

PCT Pub. Date: Jul. 25, 2002

(65) Prior Publication Data

US 2003/0148697 A1 Aug. 7, 2003

(30) Foreign Application Priority Data

Jan. 18, 2001 (JP) ..... 2001-9797
Aug. 1, 2001 (JP) ..... 2001-233246
Nov. 22, 2001 (JP) ..... 2001-357140

(51) Int. Cl.[7] ..... H01J 9/42

(52) U.S. Cl. ..... 445/3; 445/63; 445/30; 445/66

(58) Field of Search ..... 445/3, 63, 30, 445/66

(56) References Cited

U.S. PATENT DOCUMENTS 4,267,624 A * 5/1981 Augsburger ..... 445/3
4,950,192 A * 8/1990 Rietdijk et al. ..... 445/3
5,145,432 A * 9/1992 Midland et al. ..... 445/3
6,022,257 A * 2/2000 Saita et al. ..... 445/30

FOREIGN PATENT DOCUMENTS

JP 4-70277 6/1992
JP 9-7504 1/1997
JP 9-27274 1/1997
JP 10-64421 3/1998
JP 2000-353470 12/2000

* cited by examiner

*Primary Examiner*—Kenneth J. Ramsey
(74) *Attorney, Agent, or Firm*—Merchant & Gould P.C.

(57) ABSTRACT

A position of an inner surface of a panel (10) is measured with the panel being held, and a position of a main surface of a color selection electrode (30) is measured with a color selection electrode frame (40) being held, so that the measured positional data provide a measured value corresponding to a spacing between the panel inner surface and the main surface of the color selection electrode. In a state that the engaging holes of the supporting members are engaged with dummy pins (200) arranged in a predetermined positional relationship to the panel pins (20) on the condition that the panel is held, the position of the main surface of the color selection electrode is adjusted with respect to engaging holes on the basis of the predetermined positional relationship and the measured value, and supporting members are fixed by welding to the color selection electrode frame.

18 Claims, 20 Drawing Sheets

METHOD OF ASSEMBLING COLOR CRT AND ASSEMBLING DEVICE

TECHNICAL FIELD

The present invention relates to a method of assembling a color cathode ray tube used for a television receiver, a computer display or the like, and also an apparatus used for assembling the color cathode ray tube.

BACKGROUND ART

A typical color cathode ray tube as shown in FIG. 19 comprises a flat or convex color selection electrode 3 opposed to a panel inner surface 1*a* of a cathode ray tube. The color selection electrode 3 is fixed and held by a color selection electrode frame 4. A panel 1 comprises a plurality of panel pins 2 on the inner surface of its skirt part. One end of each supporting member 5 is engaged with a panel pin 2, while the other end is weld-fixed to the color selection electrode frame 4, and thus the color selection electrode frame 4 is supported by the panel 1 via the supporting members 5.

For setting a spacing (hereinafter referred to also as 'Q value') between the panel inner surface 1*a* and the outer surface 3*a* of the color selection electrode 3, JP-A-9-7504 discloses the following method of assembling a color cathode ray tube.

FIG. 20 shows one of four panel pins 2 provided at the inner surface of the skirt part of the panel 1. Here a virtual plane 2*a* (indicated by an alternate long and short dash line) is determined by three panel pins 2 as positioning points. Then, distances A1 and A2 between the virtual plane 2*a* and predetermined points on the panel inner surface 1*a* are measured.

FIG. 21 shows a pedestal 8 provided with a mask receiver 6 and three dummy pins 7 (only one of the dummy pins is shown). The dummy pin 7 corresponds to the panel pin 2 shown in FIG. 20. On the mask receiver 6, the color selection electrode 3 is placed so that the outer surface 3*a* is contacted with the upper surface of the mask receiver 6. Furthermore, a color selection electrode frame 4 is prepared by attaching supporting members 5. Each supporting member 5 is supported by three dummy pins 7 so that the color selection electrode frame 4 is held at a position opposing the color selection electrode 3. Here, a virtual panel inner surface 9 is given as a standard curved surface by taking the distance Q value from the outer surface 3*a* of the color selection electrode 3 into consideration, so that 'a1' and 'a2' denote distances between the virtual flat surface 7*a* determined by the three dummy pins 7 and predetermined points on the virtual panel inner surface 9. Next, height of each dummy pin 7, i.e., a position of the dummy pin 7 in a Y direction, is adjusted so that the distances 'a1' and 'a2' meet the measured distances A1 and A2. The color selection electrode 3 and the color selection electrode frame 4 are welded to each other under this condition.

Accordingly, the color selection electrode 3 can be located at a predetermined position with respect to the panel 1, without any need for actual positioning of the color selection electrode 3 with respect to the panel 1.

However, the above-described method of assembling a color cathode ray tube cannot satisfy requirements in improving the accuracy of the Q value as a distance between the panel inner surface 1*a* and the outer surface 3*a* of the color selection electrode, which is required for providing color cathode ray tubes with high resolution. The reasons follow.

The above-described assembly method requires two devices. One of them shown in FIG. 20 is used for measuring a distance between a virtual flat surface 2*a* determined by the three panel pins 2 and the panel inner surface 1*a*. The other device is used for measuring a distance between the virtual flat surface 7*a* determined by the dummy pins 7 and the virtual panel inner surface 9 in a state that the color selection electrode 3 is placed on the mask receiver 6, and for adjusting the dummy pins 7 to be located at predetermined positions as shown in FIG. 21. The Q value is set on the basis of the measured distances, all of which are obtained respectively by using virtual surfaces. Since the values are not obtained in a direct measurement of the spacing between the panel inner surface 1*a* and the color selection electrode outer surface 3*a*, there may be differences between the measured values and a true value, often resulting in variation in the Q value.

This will cause a problem of degraded accuracy of the Q value, i.e., a distance between the panel inner surface 1*a* and the outer surface 3*a* of the color selection electrode in a color cathode ray tube as a finished product. Moreover, since the outer surface 3*a* of the color selection electrode is contacted with the mask receiver 6, the outer surface 3*a* of the color selection electrode may be dented or scratched. The above-described problems have hindered improvement of the resolution of color cathode ray tubes.

Another problem is the complicated structure, since the two devices for setting the Q values respectively require control circuits for measurement of distances.

DISCLOSURE OF INVENTION

It is an object of the invention to provide a method of assembling a color cathode ray tube that can improve the accuracy of the Q value as a distance between a panel inner surface and a color selection electrode outer surface. It is another object of the invention to reduce the occurrence of dents and scratches on the color selection electrode outer surface, and provide for a simple control circuit to be used during a measurement of the Q value.

Methods of and apparatuses for assembling color cathode ray tubes according to the present invention are applied to a color cathode ray tube that has a panel provided with a plurality of panel pins protruding from an inner surface of the panel, a plurality of supporting members provided with engaging holes respectively at first ends, and a color selection electrode frame attached with a color selection electrode, wherein second ends of the supporting members are fixed by welding respectively to the color selection electrode frame, and the engaging holes are engaged respectively with the panel pins.

The assembly method according to the present invention comprises: holding the panel and measuring the position of the inner surface of the panel; holding the color selection electrode frame and measuring the position of the main surface of the color selection electrode attached to the color selection electrode frame; obtaining a measured value corresponding to a spacing between the panel inner surface and the main surface of the color selection electrode on the basis of data of the measured positions; engaging the engaging holes of the supporting members with dummy pins arranged to have a predetermined positional relationship with regard to the positions of the panel pins in the state that the panel is held for the measurement; adjusting the position of the main surface of the color selection electrode with regard to the engaging holes on the basis of the positional relationship and the measured values; and fixing by welding the supporting members to the color selection electrode frame.

This method enables measuring an actual spacing between the panel inner surface and the main surface of the color selection electrode, and improves the accuracy of the Q value.

It is preferable that the dummy pins are arranged at positions separated by a predetermined distance along the axis of the color cathode ray tube from the panel pins in the state in which the panel is held, the panel inner surface is positioned opposing the main surface of the color selection electrode attached to the color selection electrode frame with a certain spacing, and the position of the main surface of the color selection electrode is adjusted with regard to the engaging holes on the basis of the measured values of the spacing between the main surface of the color selection electrode and the panel inner surface.

Thereby, the color selection electrode frame can be welded to the supporting members in a state in which the main surface of the color selection electrode is separated sufficiently from the panel, so that damage to the outer surface of the color selection electrode can be prevented. Moreover, the Q value can be measured with one set of measuring apparatus and thus the control circuit can be simplified.

Alternative processes are as follows. First distances from respective predetermined measurement positions to the panel inner surface are measured in a state in which the panel pins are fitted with panel-pin-fitting holes formed at a shifting mechanism, and then the panel pins are released from the panel-pin-engaging part. Next, the engaging holes of the supporting members are engaged with the dummy pins provided to the shifting mechanism and at the same time the color selection electrode frame is arranged opposing the supporting members. Then, second distances from the respective predetermined measurement positions to the main surface of the color selection electrode attached to the color selection electrode frame are measured. Subsequently, the position of the main surface of the color selection electrode frame is adjusted so that the second distances become equal to respective sums of the respective first distances and a specified value after canceling a distance along the axis of the color cathode ray tube between the position of the panel-pin-fitting holes during the measurement of the first distances and the position of the dummy pins during the measurement of the second distances, and then the supporting members and the color selection electrode frame are welded together.

An assembly apparatus of the present invention comprises: a panel-holding member for holding the panel; dummy pins for engaging with the engaging holes of the supporting members; a frame-shifting mechanism for holding the color selection electrode frame and adjusting the position of the color selection electrode frame; a measuring device for measuring an inner surface position of the panel held by the panel-holding member and also measuring a position of a main surface of the color selection electrode attached to the color selection electrode frame held by the frame-shifting mechanism; and a welding device for fixing by welding together the supporting members having the engaging holes engaged with the dummy pins and the color selection electrode frame held by the frame-shifting mechanism.

It is preferable that the panel-holding member holds the panel and at the same time the frame-shifting mechanism holds the color selection electrode frame so that the main surface of the color selection electrode opposes the inner surface of the panel with a spacing, the dummy pins are positioned with a predetermined distance from the panel pins of the panel held by the panel-holding member along the axis of the color cathode ray tube, and the measuring device measures a spacing between the inner surface of the panel held by the panel-holding member and the main surface of the color selection electrode attached to the color selection electrode frame held by the frame-shifting mechanism.

The assembly apparatus can have the following alternative structure. That is, the assembly apparatus additionally may comprise a shifting mechanism provided with the panel-holding member and the dummy pins, wherein the panel-holding member is composed of panel-pin-fitting holes for fitting with the panel pins so that the panel-holding member selectively holds the panel by an engagement with the panel-pin-fitting holes or the supporting members by an engagement with the dummy pins. The measuring device measures first distances from respective predetermined measurement positions to the panel inner surface in a state in which panel pins are engaged with the panel-pin-fitting holes, and measures second distances from the respective predetermined measurement positions to the main surface of the color selection electrode attached to the color selection electrode frame in a state in which the engaging holes of the supporting members are engaged with the dummy pins. The position of the main surface of the color selection electrode is adjusted with respect to the engaging holes of the supporting members on the basis of the data of the first and second distances.

BEST MODE FOR CARRYING OUT THE INVENTION

First Embodiment

A method of assembling a color cathode ray tube in a first embodiment of the present invention is described below referring to some drawings.

Figure 1:
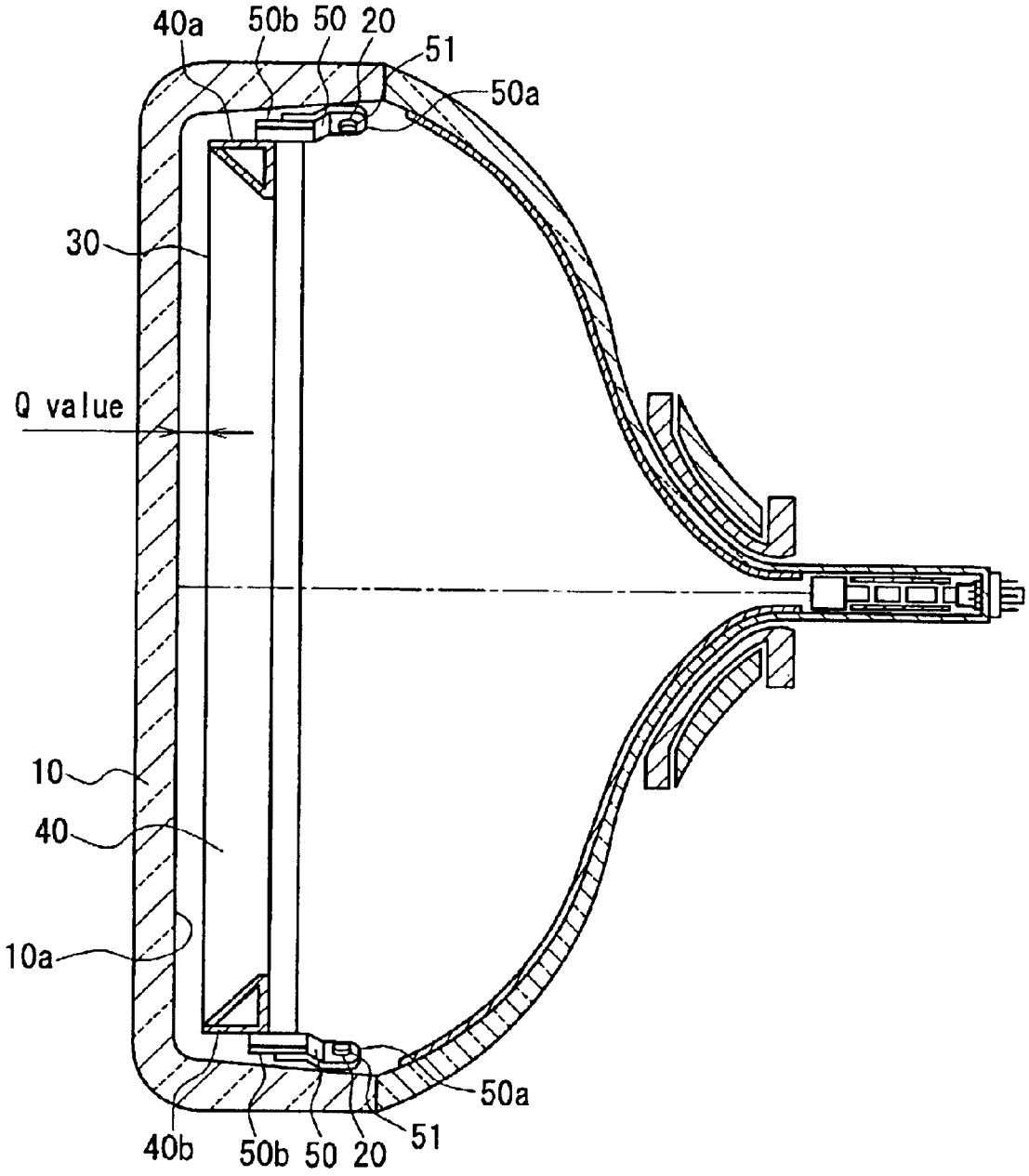
FIG. 1 is a cross-sectional view showing an example of a color cathode ray tube manufactured by an assembly method of the present invention.

FIG. 1 shows an example of a flat type color cathode ray tube to which the assembly method can be applied. The cathode ray tube comprises a flat or convex color selection electrode 30 opposed to an inner surface 10*a* of a panel 10. The color selection electrode 30 is fixed and held by a color selection electrode frame 40. The panel 10 has a plurality of panel pins 20 protruding inward from the inner surface at its skirt part. First ends of the supporting members 50 are engaged with panel pins 20 while second ends are weld-fixed to the color selection electrode 40. Thereby, the color selection electrode 40 is supported by the panel 10 via the supporting members 50.

The color selection electrode frame 40 comprises a pair of supporting frames 40*a* and 40*b* arranged opposing each other in parallel, and the color selection electrode 30 is stretched over the supporting frames 40*a* and 40*b*. The supporting members 50 have engaging holes 51 at first ends 50*a* for engaging with the panel pins 20, while the second ends 50*b* are weld-fixed to the color selection electrode 40.

Next, a method of assembling a color cathode ray tube in this embodiment is described below referring to the assembly apparatus shown in FIGS. 2–5.

Figure 2:
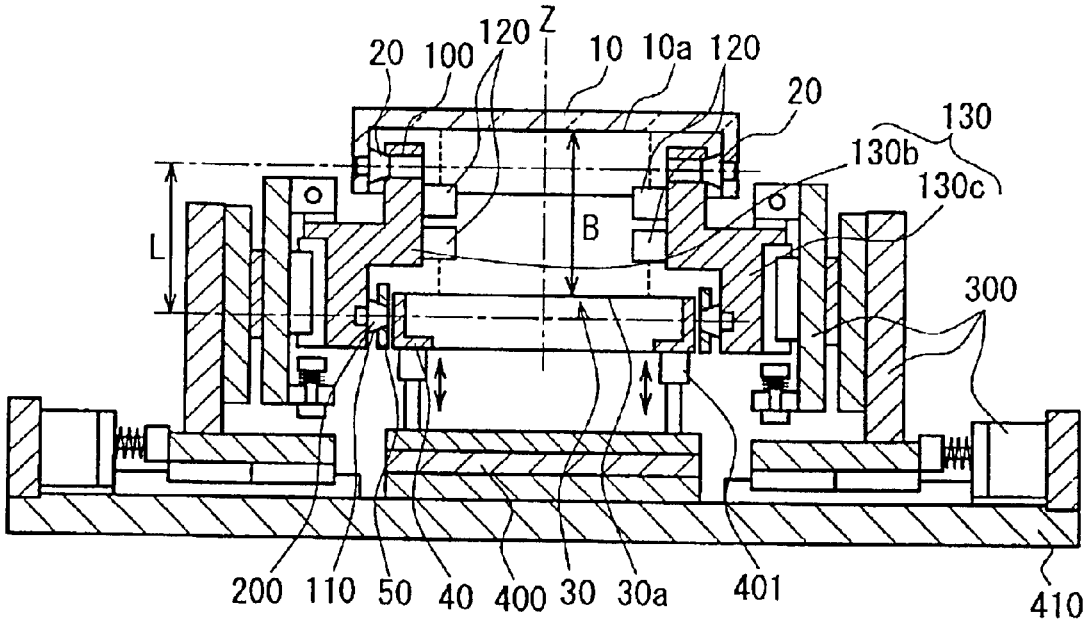
FIG. 2 is a front cross-sectional view showing an assembly apparatus for performing a method of assembling a color cathode ray tube in a first embodiment of the present invention.
Figure 3:
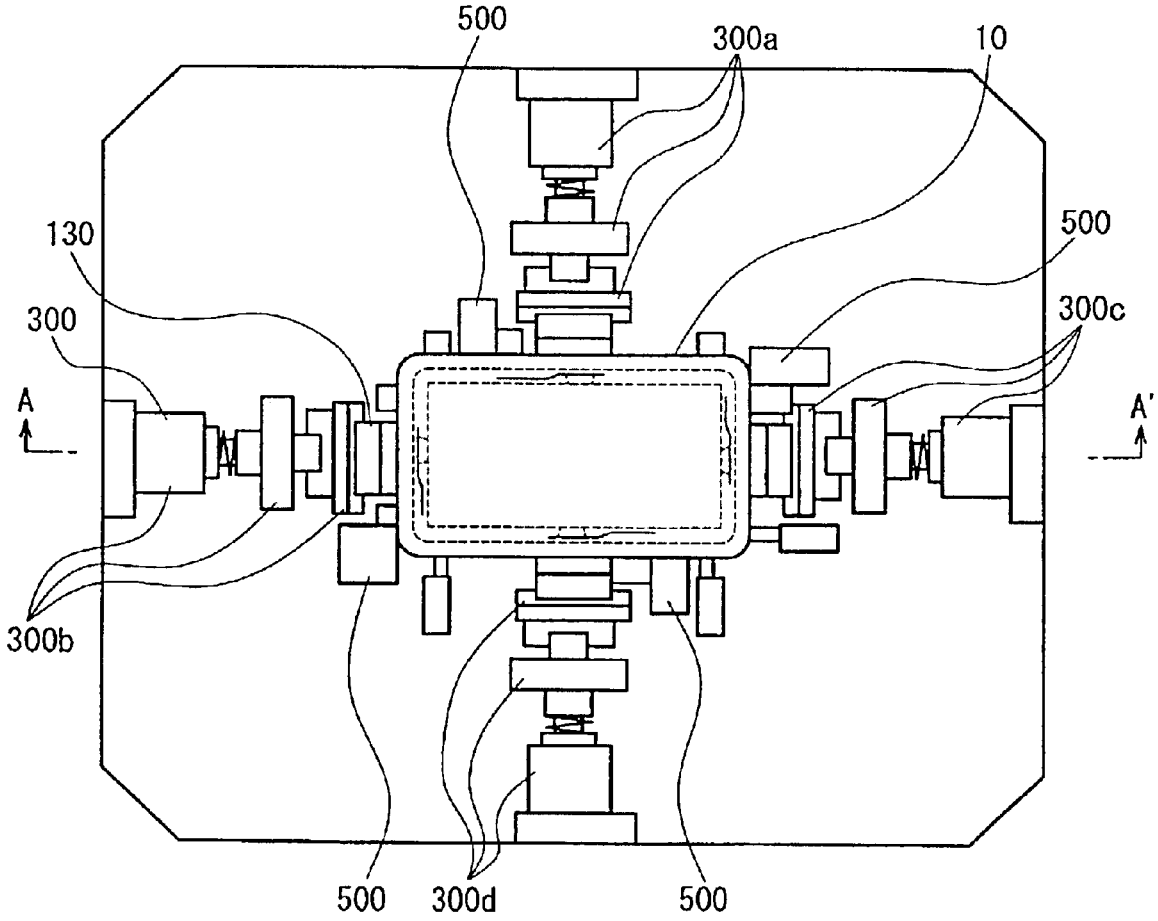
FIG. 3 is a plan view of the assembly apparatus shown in FIG. 2.

A whole structure of the assembly apparatus is shown in FIGS. 2 and 3. FIG. 2 is a front cross-sectional view and FIG. 3 is a plan view, i.e., FIG. 2 shows a cross section taken along a line A–A' of FIG. 3. This assembly apparatus comprises a holding mechanism 130 for holding the panel 10, a panel-shifting mechanism 300 for shifting the panel 10 to a predetermined position, a frame-shifting mechanism 400 for shifting the color selection electrode frame 40 having the color selection electrode 30, and a welding device 500 (shown in FIG. 3 only) for pinching and welding the ends of the supporting members 50 and the color selection electrode frame 40.

The holding mechanism 130 is composed of plural (e.g., four) holding members 130*a*, 130*b*, 130*c* and 130*d* corresponding the respective panel pins 20. Each of the holding members 130*a*–130*d* has at the upper end a panel-pin-fitting hole 100 for engaging with the panel pin 20 of the panel 10, while at the lower end, it has a dummy pin 200 for engaging with an engaging hole 51 of a supporting member 50, so that the holding mechanism 130 functions as a complex holding mechanism. Dummy pins 200 are positioned with a predetermined spacing L from the panel-pin-fitting holes 100 along an axial Z direction of the color cathode ray tube. As shown in FIG. 2, each dummy pin 200 has a shape identical to that of a panel pin 20, and it is positioned so as to overlap with each panel pin 20 in the location taken from a plan view. Each of the holding members 130*a*–130*d* is provided with a detection element 120 at the middle part, and the detection elements 120 are used for measuring a spacing B between the panel inner surface 10*a* and the outer surface 30*a* as a main surface of the color selection electrode 30. The detection elements 120 are applied as pairs of elements, and each pair of the detection elements 120 are aligned vertically. Upper detection elements 120 measure a distance to a position of the panel inner surface 10*a*, while the lower detection elements 120 measure a distance to a position of the outer surface 30*a* of the color selection electrode 30. A spacing between the vertical pair of the detection elements 120 is added to measured values provided by the respective detection elements 120 in order to obtain a measured value of the spacing B.

Figure 4:
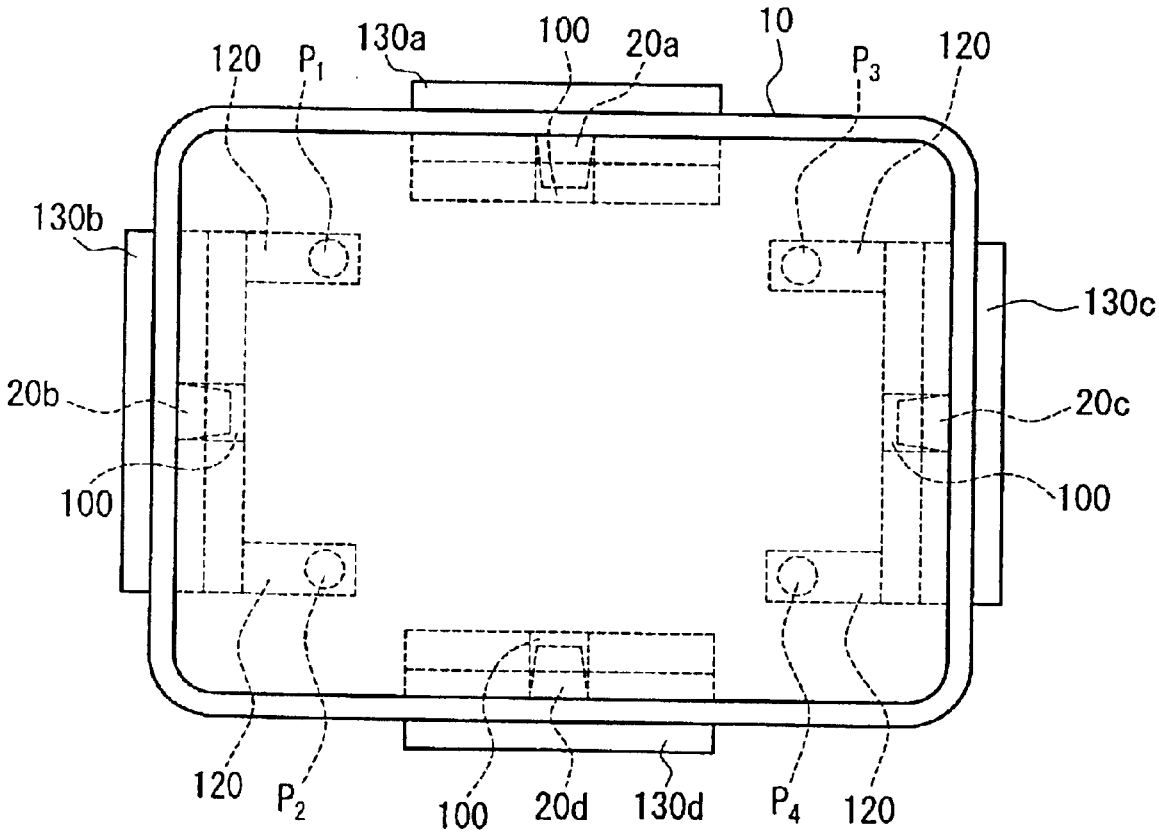
FIG. 4 is a schematic plan view showing a relationship between the assembly apparatus and a panel.

FIG. 4 is a schematic plan view showing a relationship between the assembly apparatus and the panel 10. As shown in FIG. 4, the panel 10 is held by respectively engaging four panel pins 20 of the panel 10 with the four panel-pin-fitting holes 100 provided for the holding members 130*a*–130*d*. P1–P4 in FIG. 4 denote predetermined points for measurement by the detection elements 120.

Figure 5:
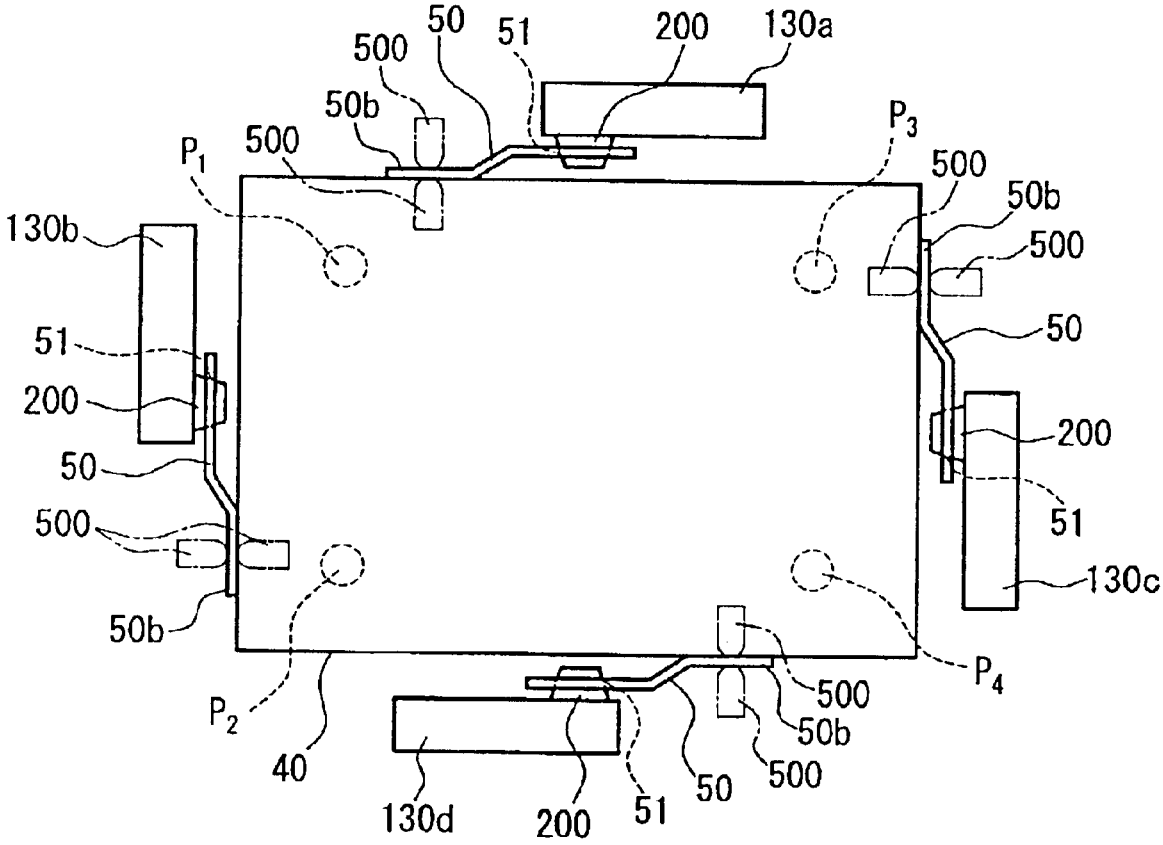
FIG. 5 is a schematic plan view showing a relationship between the assembly apparatus and a color selection electrode frame.

FIG. 5 shows a relationship between the assembly apparatus and the color selection electrode frame 40. FIG. 5 is a plan view observed from the outer surface of the panel 10 (from above in FIG. 2). As shown in FIG. 5, the dummy pins 200 position the support members 50 by engaging with the engaging holes 51 of the respective support members 50.

Since the spacing L in the holding mechanism 130 has an influence on the accuracy of the Q value, components that may influence on the spacing L, such as the panel-pin-fitting holes 100 and dummy pins 200, are produced with improved accuracy in the machining processing and assembly. To the detection elements 120, a control circuit (not shown) is connected for measuring distances or the like. In this embodiment, shifting due to the frame-shifting mechanism 400 is controlled by this control circuit so that the spacing B at any specified point will be equal to a predetermined value (corresponding to Q value).

The panel-shifting mechanism 300 is composed of four mobile units 300*a*, 300*b*, 300*c* and 300*d* provided corresponding to the respective holding members 130*a*–130*d*. Each of the mobile units 300*a*–300*d* is fixed at one end to a substrate 410 while supporting at the other end each of the holding members 130*a*–130*d*. Each of the mobile units 300*a*–300*d* has a well-known structure of a slide table or the like in order to shift each of the holding members 130*a*–130*d* freely in any direction such as up-and-down, right-and-left, and back-and-forth directions, so that the position of the panel 10 held by the holding mechanism 130 is adjusted.

The frame-shifting mechanism 400 is fixed at one end to the substrate 410. The other end of the frame-shifting mechanism 400 is attached with a mask-mounting member 401 for mounting the color selection electrode frame 40. The frame-shifting mechanism 400 has a well-known structure such as a slide table, so that it shifts freely the color selection electrode frame 40 mounted on the mask-mounting member 401 in any directions of up-and-down, right-and-left, and back-and-forth so that the position of the color selection electrode frame 40 is adjusted with respect to the panel inner surface 10*a*.

As shown in FIG. 5, welding devices 500 are provided respectively to the four supporting members 50.

The following description relates to a method of assembling a color cathode ray tube in the embodiments performed using the above-described assembly apparatus.

First, as shown FIG. 2, a panel 10 is arranged opposing a holding mechanism 130 in a state that a panel inner surface 10*a* faces downward.

Then, a panel-shifting mechanism 300 is shifted so as to fit the respective panel pins 20 of the panel 10 with the respective panel-pin-fitting holes 100 of the holding mechanism 130, and also to fit the respective engaging holes 51 of the supporting members 50 with the respective dummy pins 200 of the holding mechanism 130. Thereby, the panel 10 and the supporting members 50 are set to the holding mechanism 130.

Then, a color selection electrode frame 40 holding a color selection electrode 30 is mounted on a mask-mounting member 401 of a frame-shifting mechanism 400 as shown in FIG. 2. After the mounting, the outer surface 30*a* of the color selection electrode opposes the panel inner surface 10*a*, and the color selection electrode frame 40 is contacted with the mask-mounting member 401 at a side not holding the color selection electrode 30. Since nothing will be contacted with the color selection electrode outer surface 30*a*, the occurrence of dents, scratches or the like on the color selection electrode outer surface 30*a* can be avoided.

Subsequently, the frame-shifting mechanism 400 is shifted so that the side face of the color selection electrode frame 40 opposes the end faces of the supporting members 50 as shown in FIG. 5. At the same time, the spacing B between the panel inner surface 10*a* and the outer surface 30*a* of the color selection electrode is measured using the detection elements 120 in order to adjust the position of the outer surface 30*a* of the color selection electrode with regard to the panel inner surface 10*a* and so set the color selection electrode frame 40 at a predetermined position. At this time, the panel 10 and the color selection electrode 30 are matched at the axial centers and furthermore, the spacing B at predetermined points P1–P4 in FIG. 4 is adjusted to correspond with a predetermined value. That is, the spacing B as a directly measured value of a spacing between the panel inner surface 10*a* and the outer surface 30*a* of the color selection electrode is adjusted to correspond with a value obtained by adding a predetermined Q value to the spacing L in the holding mechanism 130 manufactured with an improved machine accuracy. Accordingly, the Q value for a completed color cathode ray tube can be set with a high accuracy. Moreover, since measurement of distance will be required only for the spacing B, the control circuits for measuring distances can be decreased to one, resulting in a simple apparatus.

Next, each of the welding devices 500 pinches and welds the end 50*a* of each supporting member 50 and the color selection electrode frame 40 outside the panel 10. Since the welding is carried out in a position where the welded parts of the color selection electrode frame 40 and of the supporting members 50 are spaced from the panel 10 by a certain distance L, splashes generated during a welding step may not adhere to a part for forming a phosphor surface of the panel inner surface 10*a*. Moreover, since the supporting members 50 and the color selection electrode frame 40 can be held securely in a relatively large space during the welding step, the Q value of the color selection electrode 30 can be maintained precisely. This can improve the mass production and also provide a high definition for color cathode ray tubes.

Finally, the panel-shifting mechanism 300 and the frame-shifting mechanism 400 are shifted in order to detach the panel 10 and the color selection electrode frame 40. Since the subsequent steps for forming a screen film, bonding the panel and a funnel, sealing and exhausting are identical to those in a manufacturing process of a conventional color cathode ray tube, the details are not described.

Test Examples

Figure 19:
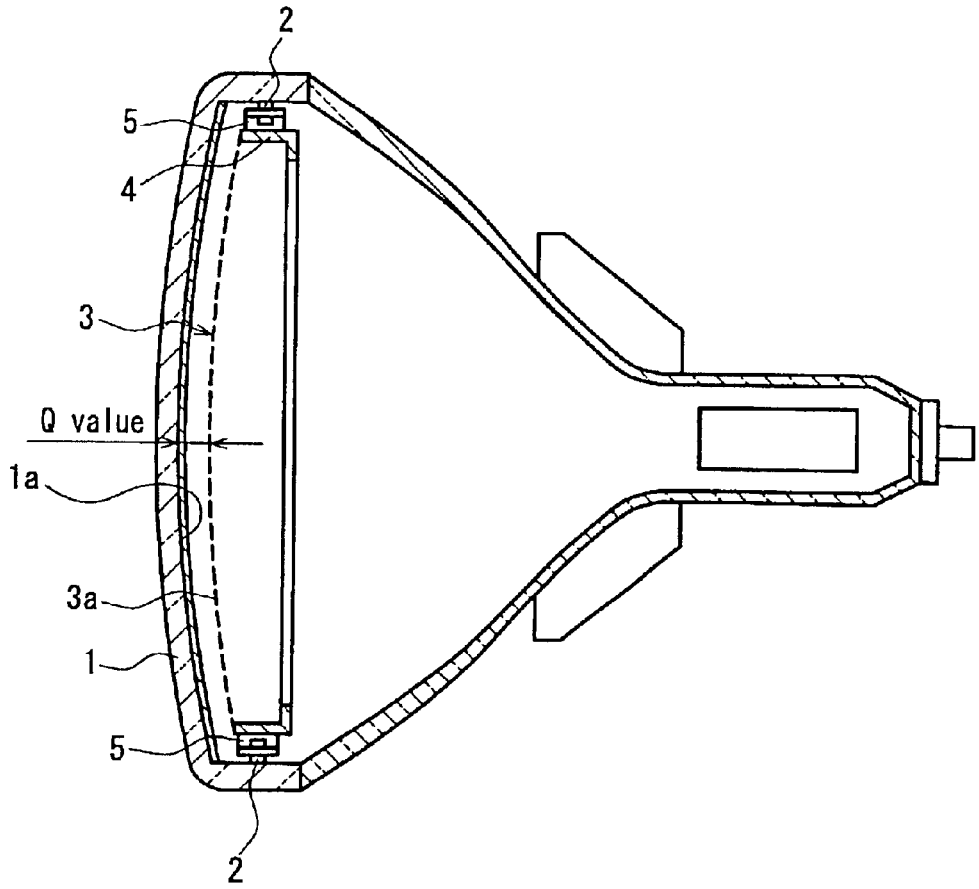
FIG. 19 a cross-sectional view showing an ordinary color cathode ray tube.
Figure 20:
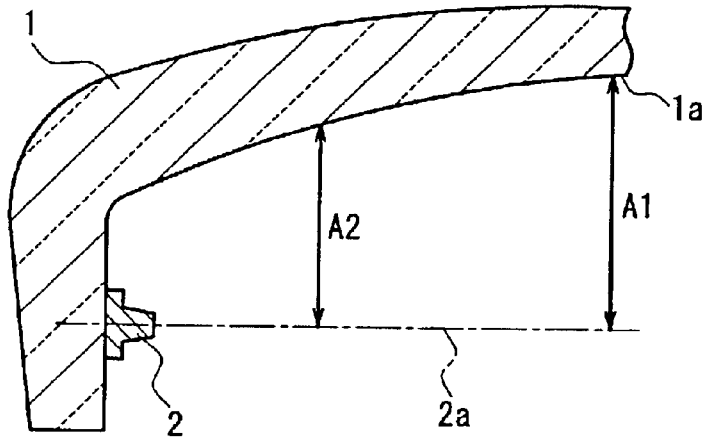
FIG. 20 is an enlarged view showing a part of a panel, relating to an explanation of a method of assembling a conventional color cathode ray tube.
Figure 21:
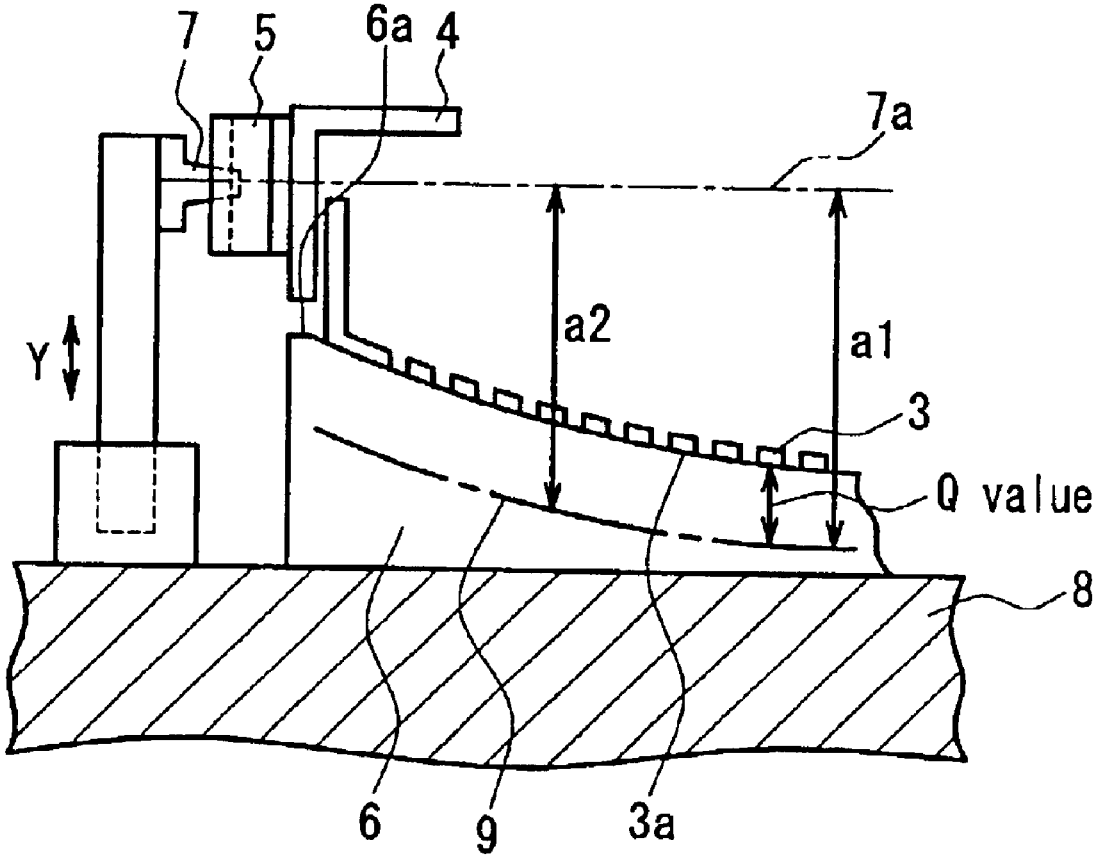
FIG. 21 is an enlarged view showing a color selection electrode frame having a color selection electrode, relating to an explanation of the assembly method.

The following description is about the results of tests performed for checking the effects of the present invention. Components were welded with color selection electrode frames by any of the method of assembling color cathode ray tubes shown in FIGS. 2–5, and also the conventional method of assembling a cathode ray tube shown in FIGS. 20 and 21. These methods were performed for producing 22-inch-sized cathode ray tubes for computer monitors as shown in FIG. 19, using convex color selection electrodes 3. The thus obtained color selection electrode frames welded with components including the color selection electrodes 3 were subjected to a test for checking a variation in the Q values.

The Q value variation was expressed by a standard deviation $\sigma$ of all Q values. For this purpose, twenty units were produced by each assembly method and the Q values were measured at four specified points in the periphery of each panel.

In the assembly method of the present invention, the Q value variation was ±23 $\mu$m. In the conventional assembly method, the Q value variation was ±31 $\mu$m. That is, the assembly method of the present invention can decrease a Q value variation by about 25% compared to the conventional assembly method, and thus, the Q value accuracy was improved remarkably.

While the conventional assembly method caused a deviation in a range from 10 $\mu$m to 20 $\mu$m for accuracy in positioning of the color selection electrode 30 with respect to the panel 10, a deviation in the present invention was in a range from 5 $\mu$m to 15 $\mu$m. Thus, the present invention can reduce the deviation to about 2/3 compared to the conventional assembly method, and the positioning accuracy of the color selection electrode 30 with respect to the panel 10 is improved remarkably.

In this embodiment, the panel 10 and the color selection electrode frame 40 were held at the same time in order to measure directly the spacing B between the panel inner surface 10*a* and the outer surface 30*a* of the color selection electrode. This is not necessarily required. Requisite conditions in adjustment of the spacing B include measurement of the panel inner surface 10*a* position while holding the panel 10, measurement of the position of the color selection electrode outer surface 30*a* while holding the color selection electrode frame 40, and setting the dummy pins 200 to be detectable their position with respect to the held position of the panel 10. Once these conditions are satisfied, the spacing B between the panel inner surface 10*a* and the outer surface 30*a* of the color selection electrode can be obtained by measuring the two positions separately and using the measured values for calculation. It is therefore possible to adjust the position of the color selection electrode frame 40 by measuring first the position of the panel inner surface 10*a* and then measuring the position of the color selection electrode outer surface 30*a* while holding the color selection electrode frame 40 alone, with an accuracy comparable with that in a direct measurement of the spacing B. This method will be explained in the following third embodiment.

This embodiment is not limited to the above-described example in which detection elements 120 are provided for a holding mechanism 130. The detection elements can be provided to any other holding mechanisms in order to measure directly the spacing B between the panel inner surface 10*a* and the outer surface 30*a* of the color selection electrode.

This embodiment is not limited to the above-described example in which respectively four panel-pin-fitting holes 100 of the holding mechanism 130 and dummy pins 200 are provided. The numbers of the panel-pin-fitting holes of the holding mechanism and the dummy pins can be set corresponding to the numbers on the panel pins of the panel inner surface, since the numbers of the panel pins will vary depending on the panel size or the like.

This embodiment is not limited to the above-described example in which the panel-pin-fitting holes 100 of the holding mechanism 130 are fitted with the panel pins 20 so that the panel is held. The panel can be held by any other means. For example, the periphery of the panel is divided into plural (e.g., three or four) equal regions and the respective peripheral surfaces are pinched with the equally divided pins for holding.

Methods of assembling color cathode ray tubes according to this embodiment are not limited to the above-described example of flat and stretched color selection electrodes 30. This embodiment can be applied to a color selection electrode having a stretched type cylindrical surface, a color selection electrode having a press-molded spherical surface, or the like.

Second Embodiment

An apparatus used in the method of assembling a color cathode ray tube in this second embodiment is modified from the assembly apparatus used in the first embodiment. Major modifications are identified in FIGS. 6–9.

Figure 6:
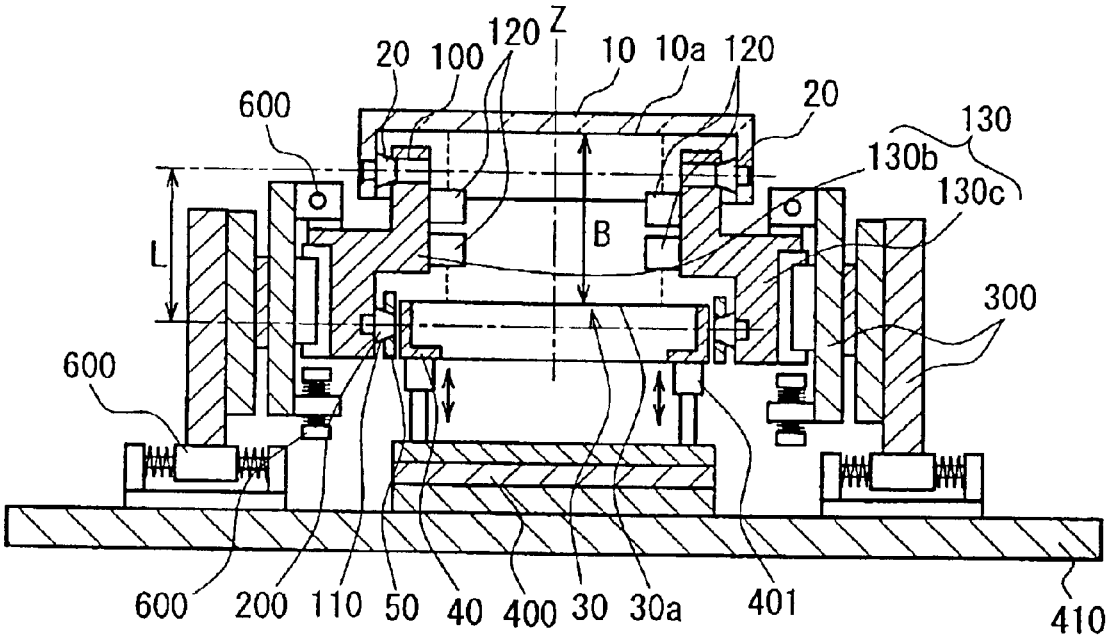
FIG. 6 is a front cross-sectional view showing an assembly apparatus for performing a method of assembling a color cathode ray tube in a second embodiment of the present invention.
Figure 7A:
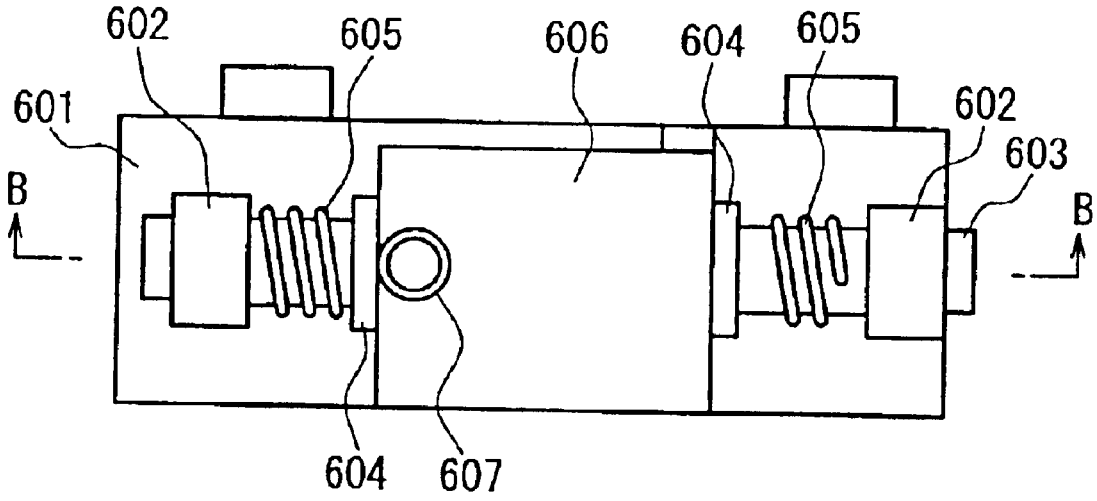
FIG. 7A is a plan view showing a locking mechanism provided to a panel-shifting mechanism of the assembly apparatus.
Figure 7B:
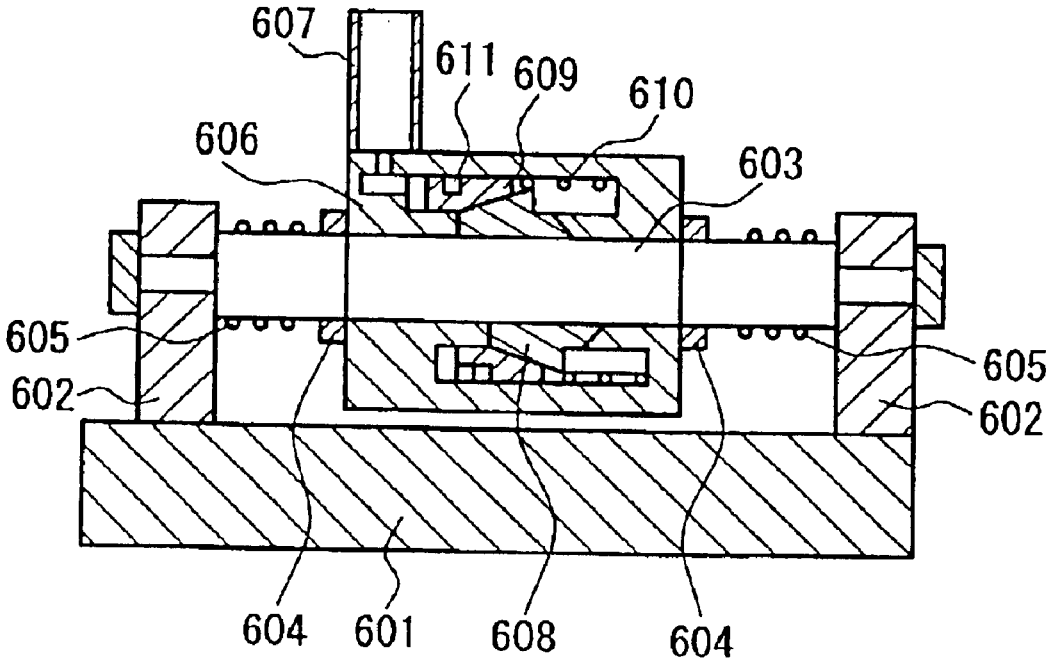
FIG. 7B is a cross-sectional view of the locking mechanism.
Figure 8:
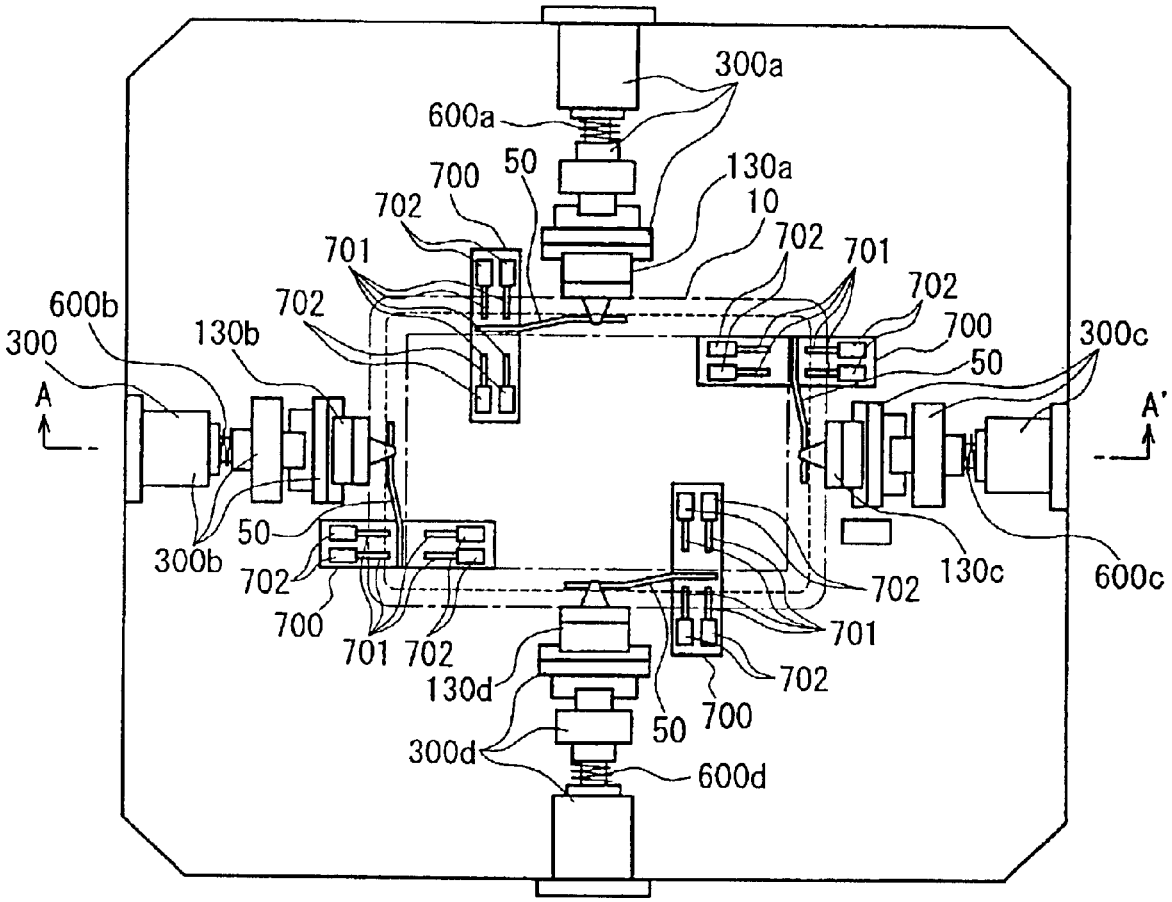
FIG. 8 is a plan view showing the assembly apparatus shown in FIG. 6.
Figure 9:
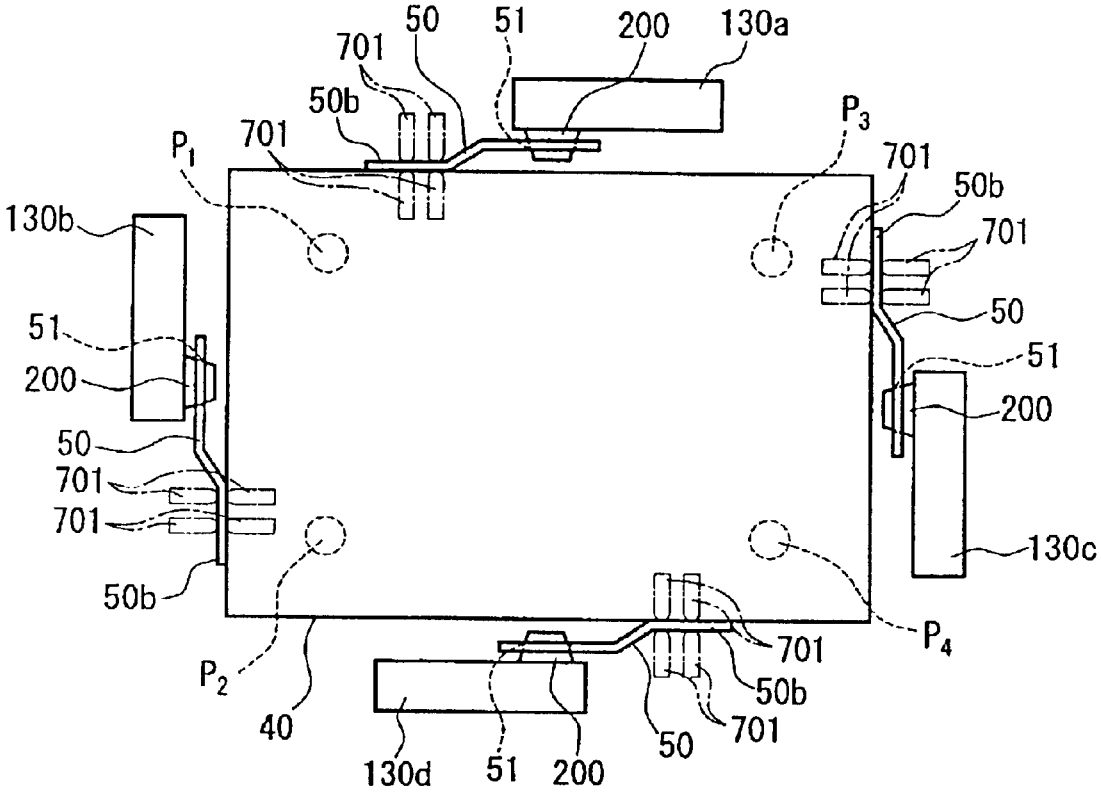
FIG. 9 is a schematic plan view showing a relationship between the assembly apparatus and a color selection electrode frame.

A first modification is a use of locking mechanisms 600 as shown in FIG. 6 and FIGS. 7A, 7B. The locking mechanisms 600 are used for fixing the position of the holding mechanism 130. A second modification is a use of welding devices as shown in FIGS. 8 and 9.

As shown in FIG. 6, locking mechanisms 600 are provided for respective mobile units 300*a*, 300*b*, 300*c* and 300*d* composing panel-shifting mechanisms 300 in order to correspond to respective holding members 130*a*, 130*b*, 130*c* and 130*d* composing the holding mechanism 130. Three locking mechanisms 600 of the same structure are provided to one mobile unit in order to fix the mobile unit against shifting in the directions of X, Y and Z axes respectively.

The locking mechanisms 600 act like typical locking mechanisms used in well-known slide tables. Therefore, detailed description will be omitted regarding the attachment of such a locking mechanism to a panel-shifting mechanism 300. A structure of the locking mechanisms 600 characterizing the second embodiment will be explained below referring to FIGS. 7A and 7B.

FIG. 7A is a plan view of a locking mechanism 600, and FIG. 7B is a cross-sectional view taken along a line B—B of FIG. 7A. As shown in FIGS. 7A and 7B, a fixing plate 601 is provided with two blocks 602 that fix a step shaft 603. Collars 604 are attached movably in an axial direction to the step shaft 603. The collars 604 are pressed against the step parts of the step shaft 603 with springs 605.

To a thick part of the step shaft 603, a housing 606 sandwiched by the collars 604 is attached to be floatable in the axial direction. The housing 606 is provided with a port 607 for feeding compressed air. In the interior of the housing 606, a collet 608 is attached to sandwich the step shaft 603. The collet 608 has a notch (not shown) and a tapered part. A piston 609 is arranged to contact with both the tapered part and an inner surface of the housing 606. A spring 610 is attached to a space between one end of the piston 609 and the housing 606. For securing the air tightness of the housing 606, the piston 609 is provided with a resin member 611.

In an example where locking mechanisms 600 are attached to a panel-shifting mechanism 300, a fixing plate 601 is fixed to a non-moving part such as a substrate 410. The housings 606 are fixed to the respective mobile units 300*a*, 300*b*, 300*c* and 300*d*. Therefore, the position of the holding mechanism 130 will be fixed by preventing the housing 606 from shifting with respect to the step shaft 603.

Welding devices 700 shown in FIGS. 8 and 9 are substantially identical to the above-described welding devices 500 in the arrangement and the basic functions. In an example, four identical welding devices 700 are arranged respectively corresponding to four supporting members 50 in an assembly apparatus. Each welding device 700 has welding holders 702 comprising welding electrodes 701. Respectively four welding electrodes 701 and four welding holders 702 are provided for a welding device 700.

The following is an explanation of a method of assembling a color cathode ray tube using the thus modified assembly apparatus.

The method is identical to the above-described method until completing the following steps of setting a panel 10 and supporting members 50 to a holding mechanism 130; and adjusting the position of a color selection electrode frame 40 by shifting a frame-shifting mechanism 400 while measuring a spacing B between a panel inner surface 10*a* and an outer surface 30*a* of a color selection electrode using detection elements 120 so that the spacing B at the respective predetermined points P1–P4 matches a previously established value.

Next, the holding mechanism 130 is fixed by locking mechanisms 600 of the panel-shifting mechanism 300. The method of fixing will be explained below referring to FIG. 7B. First, compressed air is fed from the port 607 for shifting the piston 609 to the right side of the drawing in the axial direction. Thereby, the piston 609 presses the tapered part of the collet 608, and so the collet 608 is fixed to the step shaft 603. Since this operation is carried out simultaneously with three locking mechanisms 600 provided for one panel-shifting mechanism 300, locking is provided in X, Y, and Z axes. Thereby, the respective housings 606 are prevented from floating so as to fix the holding mechanism 130. The piston 609 will return to a normal floating state by means of a spring 610 when feeding of the compressed air stops.

Therefore, the supporting members 50 fitted with the dummy pins 200 can be fixed precisely to the frame 40 by welding as mentioned below when the locking mechanisms 600 fix the position of the holding mechanism 130. The housing 606 is made floatable so that it can be adapted to a product in which positions of the panel pins 20 are varied to some degree.

Figure 10:
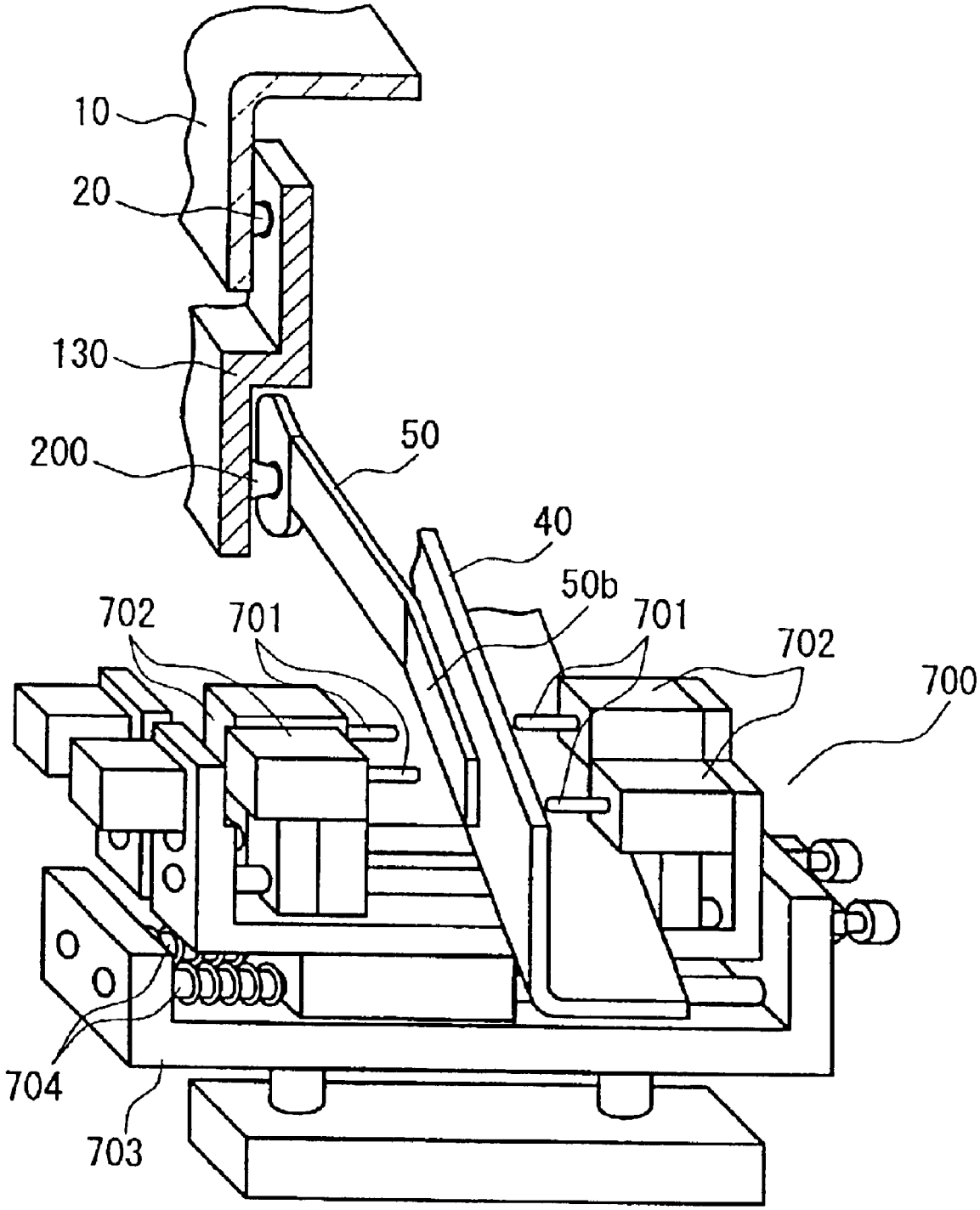
FIG. 10 is a perspective view showing a welding device provided for the assembly apparatus.

Next, the welding device 700 pinches the second end 50*b* of each supporting member 50 and the color selection electrode frame 40 for welding outside the panel 10. This welding process will be explained below in detail referring to FIG. 10.

In a state that the holding mechanism 130 is locked, the second ends 50*b* of the supporting members 50 fitted with the dummy pins 200 of the holding mechanism 130 are contacted with the color selection electrode frame 40 and the supporting members 50 and the color selection electrode frame 40 are welded together while holding them by applying pressure at both sides by means of the welding electrode 701 provided to the welding holder 702. During this process, the color selection electrode frame 40 and the supporting members 50 are continuously subjected to pressure and held until the welding is completed. Thereby, the color selection electrode frame 40 and the supporting members 50 can be welded precisely.

Welding is performed at four points simultaneously by means of four welding devices 500. Each welding device 500 is provided on a floating mechanism 703. This floating mechanism comprises a spring 704. Accordingly, the respective welding electrodes 501 arranged for pinching the color selection electrode frame 40 and the supporting members 50 can apply pressure of the same level.

Finally, the panel-shifting mechanism 300 and the frame-shifting mechanism 400 are shifted and the panel 10 and the color selection electrode frame 40 are detached. The subsequent processes for forming a screen film, bonding the panel and a funnel, sealing and exhausting or the like are identical to those of a conventional method of assembling a color cathode ray tube.

Third Embodiment

A method of assembling a color cathode ray tube in a third embodiment will be described below referring to an example of production of a color cathode ray tube shown in FIG. 1. FIGS. 11–18 show an assembly apparatus used in the process of this embodiment, and the operations of the apparatus.

Figure 11:
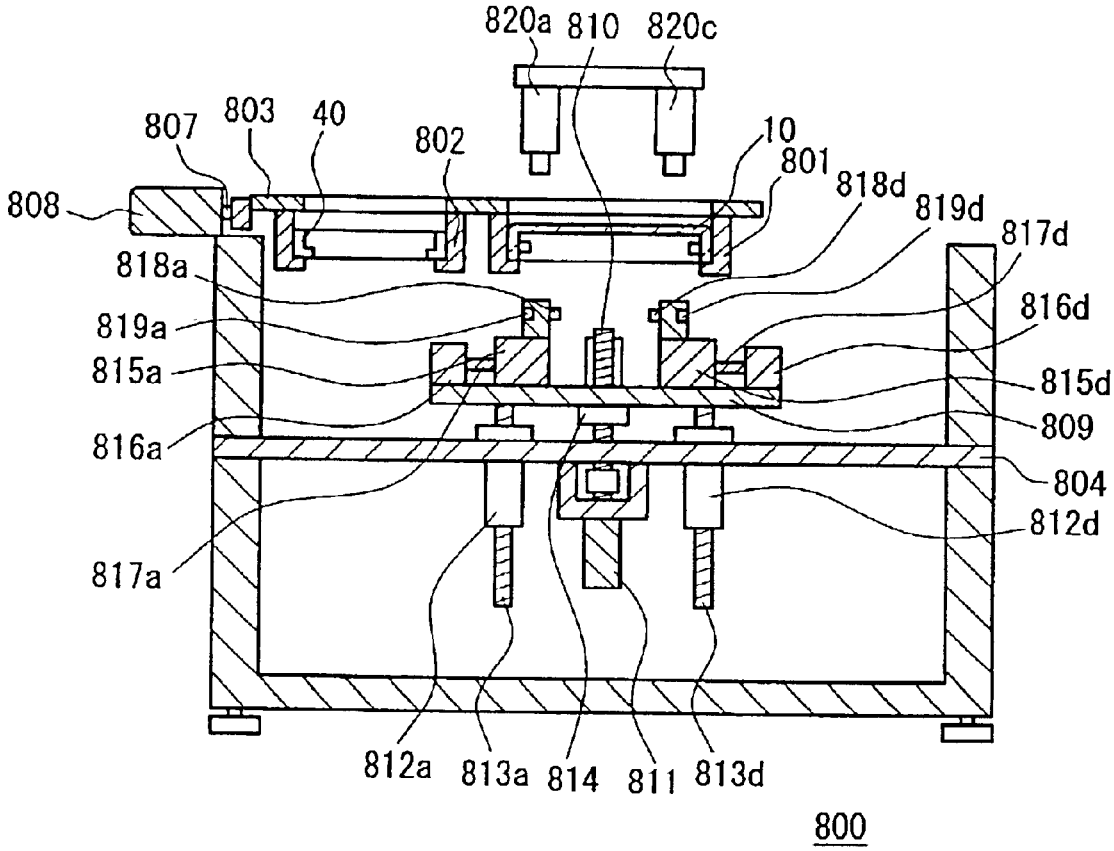
FIG. 11 is a front cross-sectional view showing an assembly apparatus for performing the method of assembling a color cathode ray tube in the second embodiment.
Figure 12:
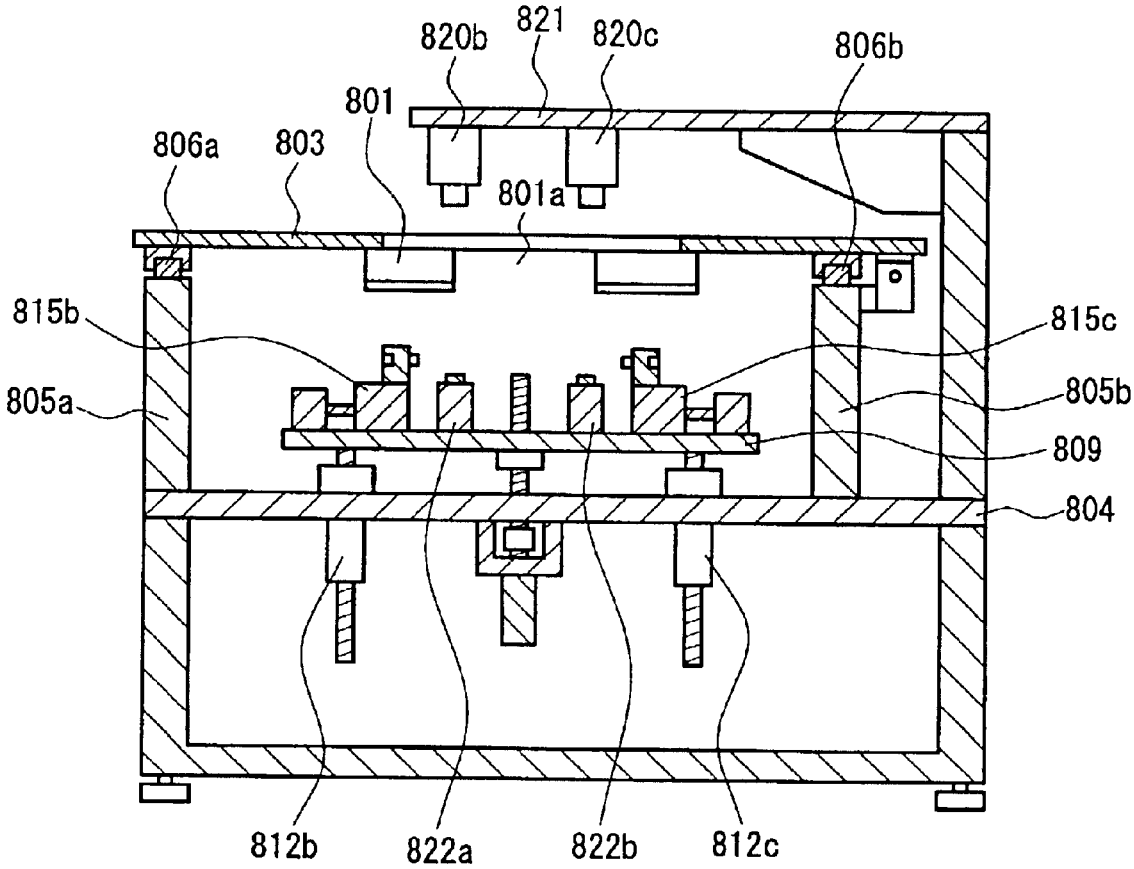
FIG. 12 is a side cross-sectional view of the assembly apparatus.

First, an apparatus 800 for assembling a color cathode ray tube according to this embodiment will be described below referring to FIGS. 11–13. FIG. 11 is a front cross-sectional view of the assembly apparatus 800, FIG. 12 is a side cross-sectional view, and FIG. 13 is a plan view.

FIG. 11 shows a shifting board 803 to which a panel-holding member 801 for holding a panel 10 and also a frame-holding mechanism 802 for holding a color selection electrode frame 40 are attached. As shown in FIG. 12, the shifting board 803 is attached to guide rails 806*a* and 806*b* provided respectively on two frames 805*a* and 805*b* formed on a base 804, and the shifting board 803 shifts on the base 804 in parallel with respect to the ground. The panel-holding member 801 has a notch 801*a* at the center. Though not shown in FIG. 12, the frame-holding mechanism 802 also has a similar notch. The notch 801*a* of the panel-holding member 801 is not essential, while the notch of the frame-holding mechanism 802 is required not to binder a component from operating as mentioned below. As shown in FIG. 11, the shifting board 803 will be shifted by driving a ball screw 807 provided for the shifting board 803 by means of a motor 808.

FIG. 11 shows an elevating plate 809 arranged on the base 804. The elevating plate 809 ascends and descends along a ball screw 810 arranged penetrating the base 804 and the elevating plate 809. This elevating plate 809 is driven by a motor 811 provided below the base 804. The elevating plate 809 is supported by slide shafts 813*a*, 813*b*, 813*c* and 813*d* that shift in a direction perpendicular to the ground (the up-and-down direction in the drawing) inside four elevating guides 812*a*, 812*b*, 812*c* and 812*d* (only the two slide shafts 812*a* and 812*d* are shown in FIG. 11) provided at the bottom surface of the base 804. For reinforcing the passage for the ball screw 810 formed at the elevating plate 809, a ball screw nut 814 is provided at the bottom surface of the elevating plate 809.

Figure 13:
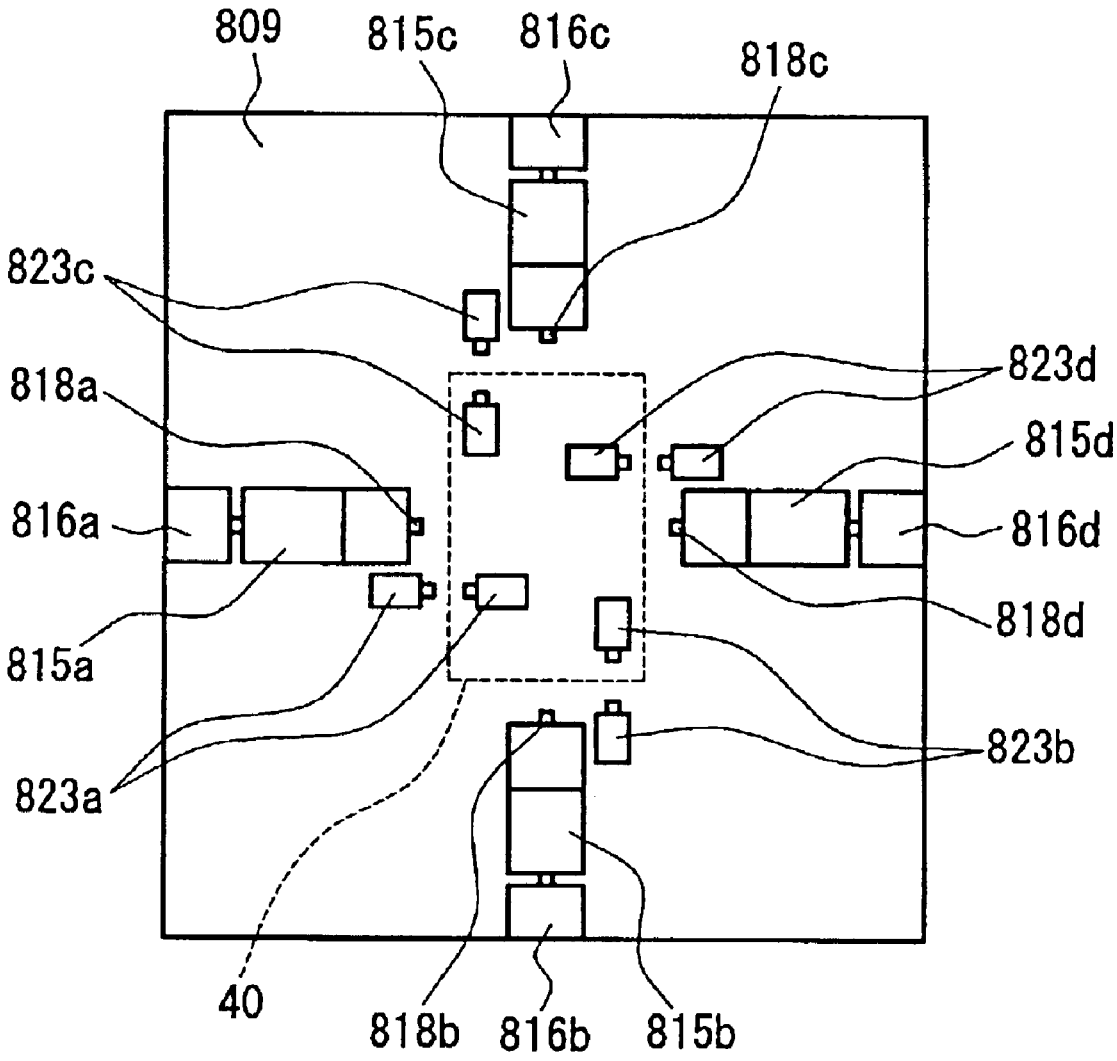
FIG. 13 is a schematic plan view of the assembly apparatus.

As shown in FIGS. 11 and 13, on the elevating plate 809, four shifting blocks 815*a*, 815*b*, 815*c* and 815*d* are arranged crosswise so that the shifting blocks can shift in the X or Y direction respectively in the horizontal plane. These shifting blocks 815*a*, 815*b*, 815*c* and 815*d* are used for supporting the panel 10 or for supporting the supporting members 50 (see FIG. 1) to be fixed to the color selection electrode frame 40, and they can float up-and-down, right-and-left, and back-and-forth. Each of the shifting blocks 815*a*, 815*b*, 815*c* and 815*d* has a locking function inside for stopping its floating. The mechanism of providing floatability and the locking mechanism are omitted from the drawings since well-known structures can be used for these mechanisms. The movement of the shifting blocks 815*a*–815*d* respectively in the X or Y direction is driven through ball screws 817*a*, 817*b*, 817*c* and 817*d* by means of four motors 816*a*, 816*b*, 816*c* and 816*d* provided on the elevating plate 809.

Dummy pins 818*a*, 818*b*, 818*c* and 818*d* are provided on the respective shifting blocks 815*a*–815*d*, and can be engaged with engaging holes formed on the supporting members 50 at the time of fixing the supporting members 50 to the color selection electrode frame 40. The dummy pin 818*a* opposes the dummy pin 818*d*, while the dummy pin 818*b* opposes the dummy pin 818*c*. Furthermore, the shifting blocks 815*a*–815*d* are provided with engaging holes 819*a*, 819*b*, 819*c* and 819*d*, respectively on the surfaces reverse to the surfaces where the respective dummy pins 818*a*–818*d* are formed. The engaging holes 819*a*–819*d* serve as panel-pin-engaging parts to be engaged with the panel pins 20 of the panel 10. These engaging holes 819*a*–819*d* are positioned at the same height as the dummy pins 818*a*–818*d*. That is, the engaging holes 819*a*–819*d* have hole axes common to the central axes of the dummy pins 818*a*–818*d*. The shape of the dummy pins 818*a*–818*d* is substantially identical to the panel pins 20 of the panel 10.

As shown in FIGS. 11 and 12, four measuring devices 820*a*, 820*b*, 820*c* and 820*d* are provided above the elevating plate 809. Specifically, the measuring devices 820*a*–820*d* are attached to predetermined controlling positions of a bracket 821 fixed to the base 804. When the panel 10 is located below the measuring devices 820*a*–820*d*, the measuring devices are used to measure a distance to the inner surface of the panel 10. When the color selection electrode 30 is located below the measuring devices, the measuring devices are used to measure a distance to the outer surface (denoted also as the main surface) of the color selection electrode 30. The number of the measuring devices is not limited to four, but maybe as few as one or more than four according to use conditions. At least three measuring devices are used preferably for obtaining spatial information on locations of the panel and the color selection electrode as well as a distance to a specified point.

As shown in FIG. 12, positioning devices 822*a* and 822*b* are provided on the elevating plate 809, and the positioning devices 822*a* and 822*b* support plural points on the bottom surface of the color selection electrode 30 fixed to the color selection electrode frame 40, and they serve to adjust the positioning in a vertical direction of the color selection electrode 30. As shown in FIG. 13, pairs of welding devices 823*a*, 823*b*, 823*c* and 823*d* are arranged for welding the supporting members 50 and the color selection electrode frame 40.

A method of assembling a color cathode ray tube using the above-described assembly apparatus 800 is explained below referring to FIGS. 14–18.

Figure 14:
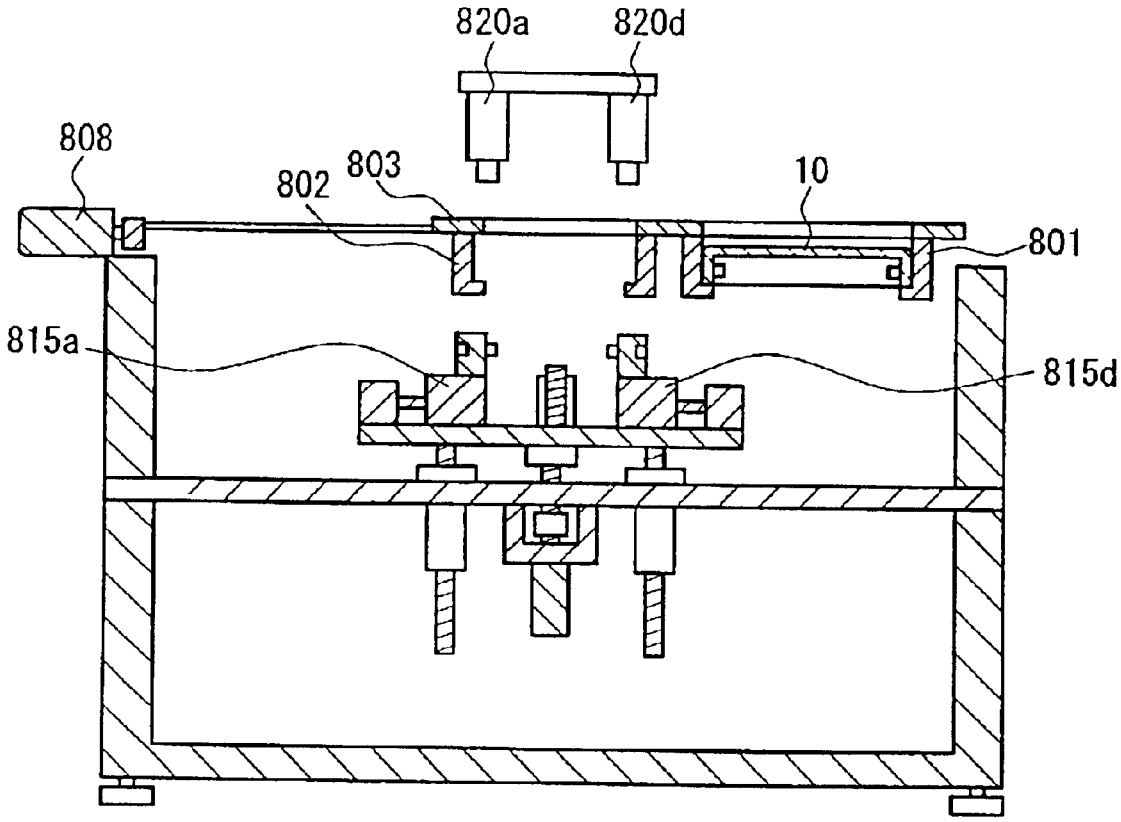
FIG. 14 is a front cross-sectional view showing a step of mounting a panel in the method of assembling a color cathode ray tube in the second embodiment of the present invention.

First, as shown in FIG. 14, a panel 10 is mounted on a panel-holding member 801 of a panel-shifting plate 803, where the tube surface of the panel faces upwards and the panel inner surface 10*a* faces downward. The panel 10 can be mounted by means of an apparatus such as an external mounting device, or it can be mounted directly by hand.

Figure 15:
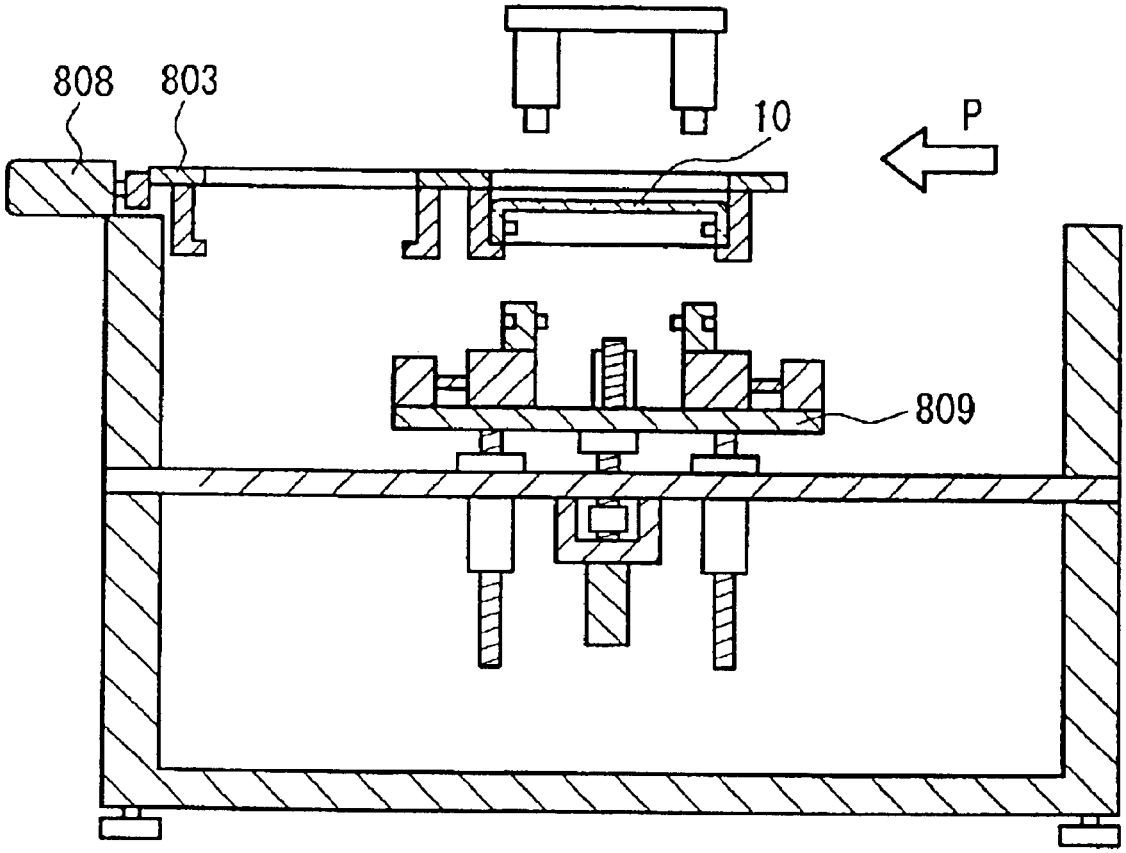
FIG. 15 is a front cross-sectional view showing a step of shifting a panel in the assembly method.

Next, the motor 808 is driven to shift the shifting plate 803 in a P direction as indicated in FIG. 15 so that the panel 10 is positioned above the elevating plate 809.

Figure 16:
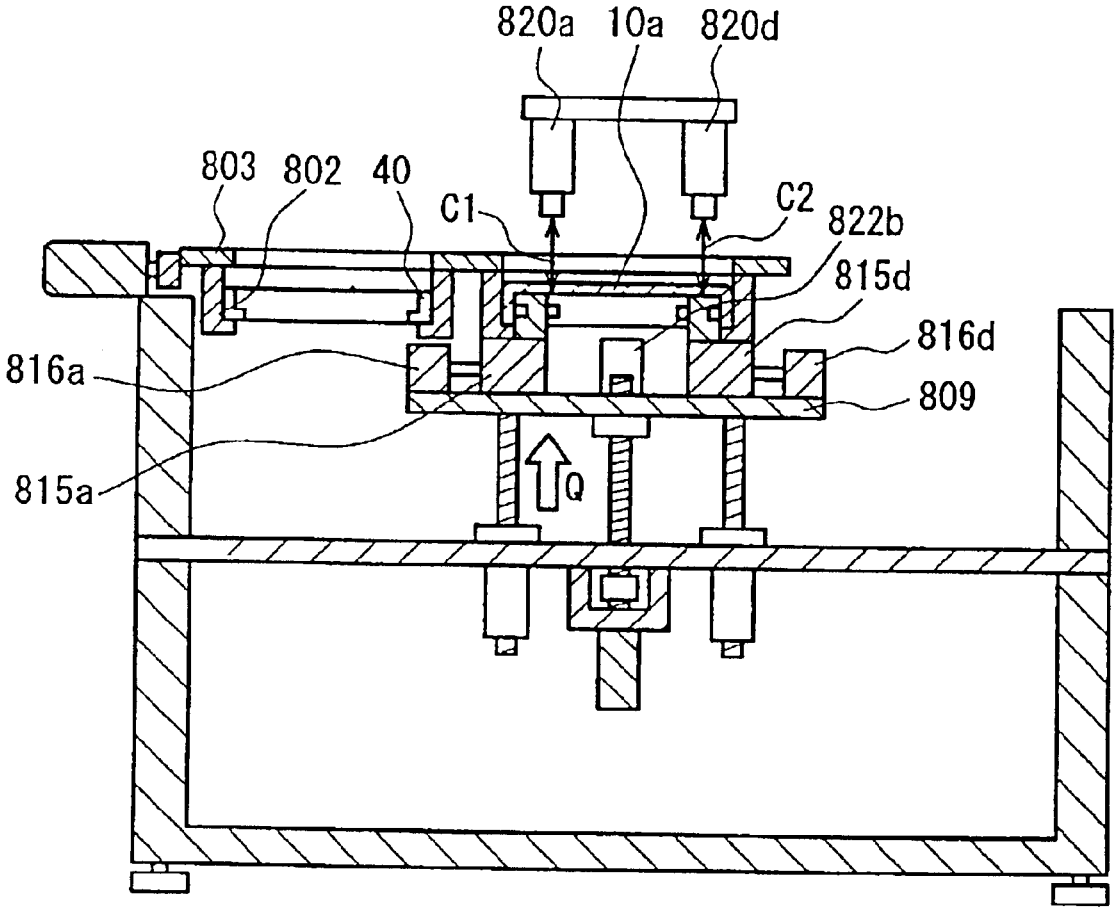
FIG. 16 is a front cross-sectional view showing a measurement of a distance C in the assembly method.

Next, as shown in FIG. 16, the elevating plate 809 is raised in a Q direction while the shifting blocks 815*a*–815*d* are advanced by means of the motors 816*a*–816*d*. Here, 'advance' denotes that each shifting block moves away from each motor. After the elevating plate 809 reaches a predetermined position, the shifting blocks 815*a*–815*d* recede so that the panel pins of the panel 10 are engaged with the engaging holes 819*a*–819*d* formed on the shifting blocks 815*a*–815*d*. At this time, the shifting blocks 815*a*–815*d* are positioned while they are floating due to the floating function and tracing function. Furthermore, the locking functions provided in the interiors of the shifting blocks operate to change the floating state to a fixed state, so that the position is locked. The positions of the shifting blocks 815*a*–815*d* are measured by means of a position measuring device (not shown). Later, measuring devices 820*a*–820*d* are used to measure distances C1–C4 (only the distances C1 and C2 shown) from the same measuring devices 820*a*–820*d* to the panel inner surface 10*a*.

Next, the panel pins 20 are detached from the engaging holes 819*a*–819*d* by advancing the shifting blocks 815*a*–815*d* and then the elevating plate 809 is lowered. Meanwhile, a color selection electrode frame 40 provided with a color selection electrode 30 is mounted on a frame-holding mechanism 802. The mounting can be carried out using an apparatus such as an external mounting device or it can be carried out directly by hand.

Figure 17:
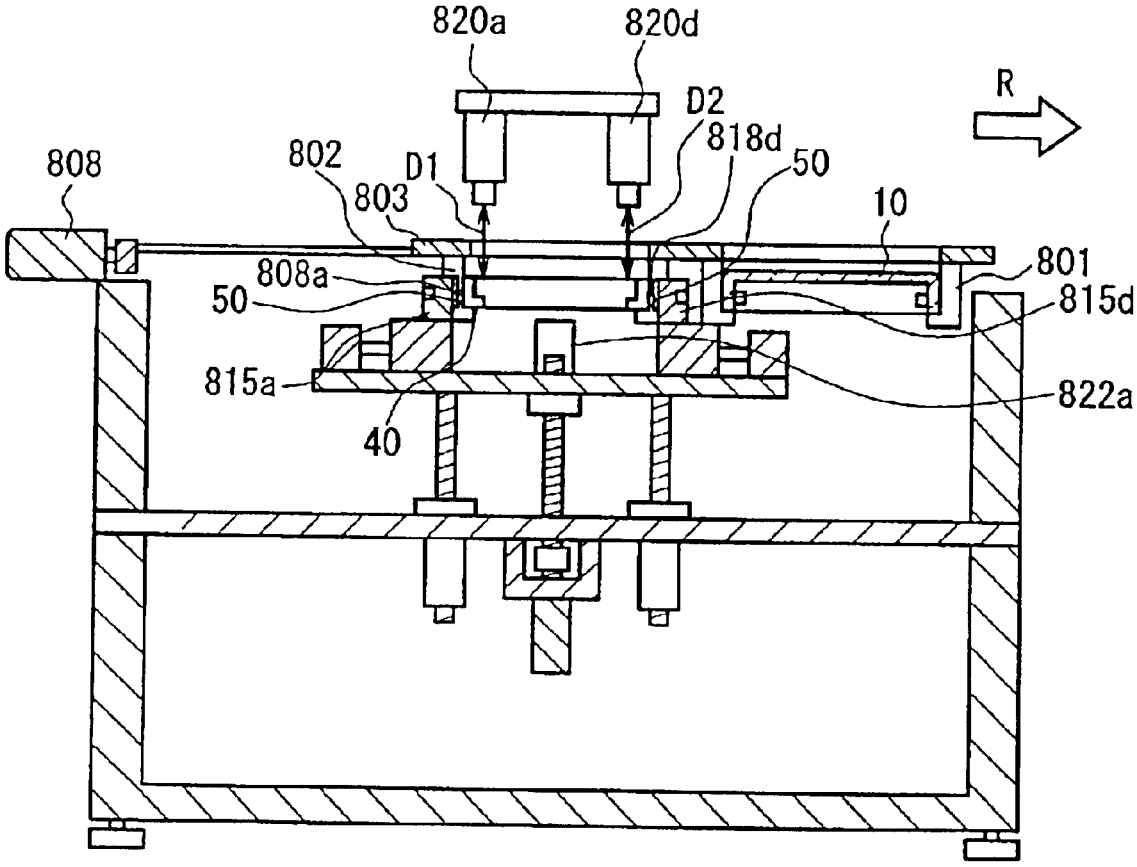
FIG. 17 is a front cross-sectional view showing a measurement of a distance D in the assembly method.

Next, as shown in FIG. 17, the shifting plate 803 is shifted in a R direction so as to position the mounted color selection electrode frame 40 above the elevating plate 809. Then, the elevating plate 809 is raised again to support the color selection electrode frame 40 by means of the positioning devices 822*a*, 822*b*. At this time, the shifting blocks 815*a*–815*b* remain receded. Under the condition, engaging holes 51 of the respective supporting members 50 are engaged with the dummy pins 818*a*–818*d* provided to the shifting blocks 815*a*–815*d* so as to support the supporting members 50. This engagement can be carried out by means of an apparatus such as an external mounting device, or it can be carried out directly by hand.

Next, as shown in FIG. 17, the shifting blocks 815*a*–815*d* are advanced so that the supporting members 50 are contacted with predetermined points of side faces of the color selection electrode frame 40. Then, the measuring devices 820*a*–820*d* are used to measure distances D1–D4 (only D1 and D2 shown) from the measuring devices to the outer surface of the color selection electrode 30 mounted on the positioning devices 822*a* and 822*b*. The distances C1–C4 and the distances D1–D4 are measured respectively by the measuring devices located at the same positions. For matching the distances D1–D4 with predetermined values, a position of the color selection electrode 30 is adjusted automatically by means of the positioning devices 822*a* and 822*b* and the shifting blocks 815*a*–815*d* while contacting the supporting members 50 to the color selection electrode frame 40. Predetermined values with respect to the distances D1–D4 are determined as follows. First, a K value is obtained as a detected difference between positions in a vertical direction of the shifting blocks 815*a*–815*d* during the measurement of the distances C1–C4 and during the measurement of the distances D1–D4. The values of the distances D1–D4 to be set are determined by adding a Q value as a specified value to be controlled to values obtained by canceling the K values from the respective distances C1–C4.

Figure 18:
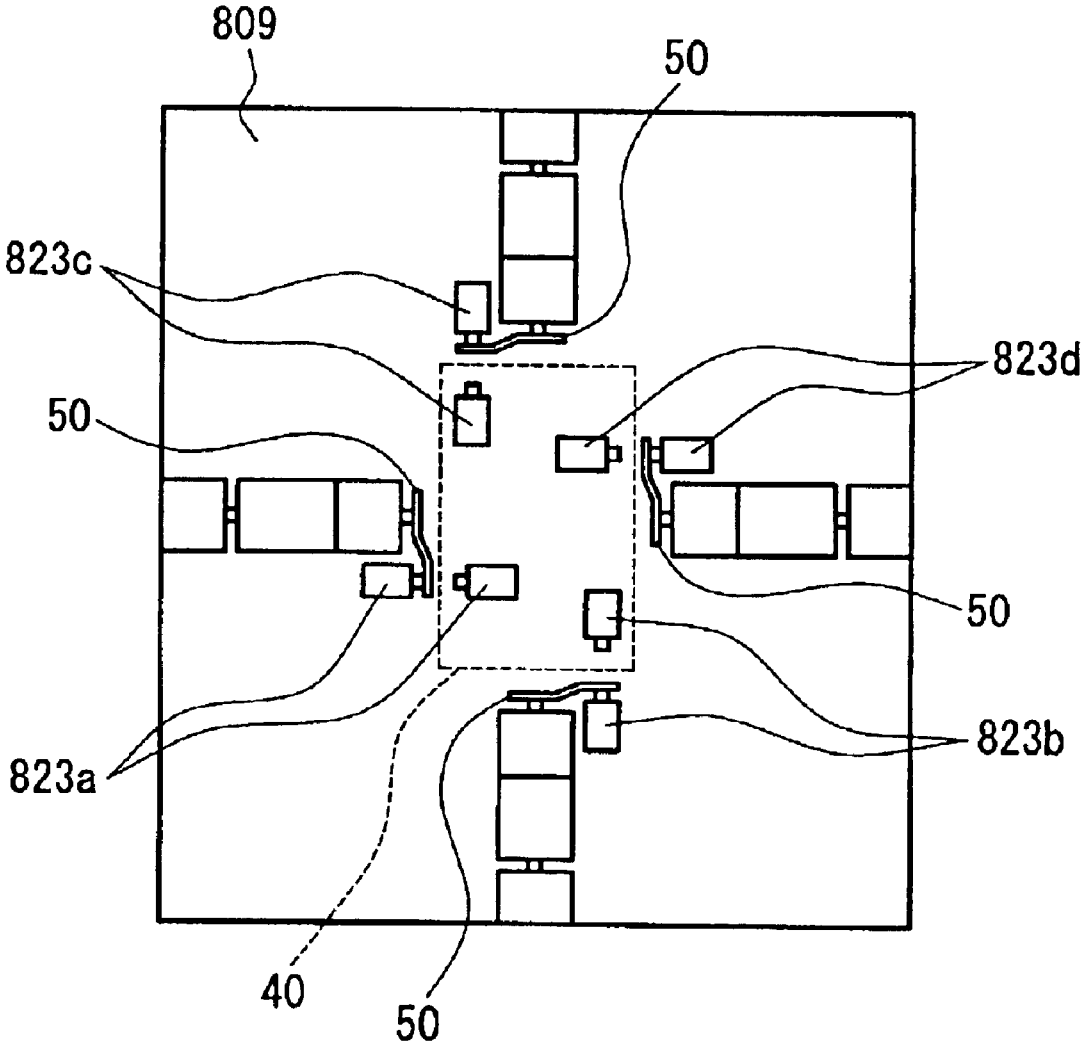
FIG. 18 is a schematic top view showing a color selection electrode frame and a supporting member during a welding step in the assembly method.

After the position setting is completed, as shown in FIG. 18, the supporting members 50 and the color selection electrode frame 40 are welded together by means of the welding devices 823*a*–823*d*.

Finally, the panel 10 and the color selection electrode frame 40 are detached from the assembly apparatus 800. Alternatively, it is possible to detach a measured panel 10 and mount a subsequent panel 10 during the above-mentioned welding. Alternatively, it is possible to detach a color selection electrode frame 40 with welded supporting members 50 and mount a subsequent color selection electrode frame 40 during a measurement of the distances C1–C4 of the panel 10.

The above process will be followed by some steps such as a screen film formation, bonding of a panel and a funnel, sealing and exhausting according to an ordinary method of assembling a color cathode ray tube, though these steps are not described.

INDUSTRIAL APPLICABILITY

The method of assembling a color cathode ray tube according to the present invention enables the improvement of accuracy of the Q value as a distance between a panel inner surface and a color selection electrode outer surface. Moreover, the method enables the reduction of the occurrence of dents and scratches on the color selection electrode outer surface, and provides a simple control circuit used during a measurement of the Q value.

What is claimed is:

1. A method of assembling a color cathode ray tube having a panel provided with a plurality of panel pins protruding from an inner surface of the panel, a plurality of supporting members provided with engaging holes respectively at first ends, and a color selection electrode frame attached with a color selection electrode, wherein second ends of the supporting members are fixed by welding respectively to the color selection electrode frame, and the engaging holes are engaged respectively with the panel pins, the method comprising:

holding the panel and measuring the position of the inner surface of the panel;

hold ing the color selection electrode frame and measuring the position of the main surface of the color selection electrode attached to the color selection electrode frame;

obtaining a measured value corresponding to a spacing between the panel inner surface and the main surface of the color selection electrode on the basis of data of the measured positions;

engaging the engaging holes of the supporting members with dummy pins arranged to have a predetermined positional relationship with regard to the positions of the panel pins in the state that the panel is held for the measurement;

adjusting the position of the main surface of the color selection electrode with regard to the engaging holes on the basis of the positional relationship and the measured values; and fixing by welding the supporting members to the color selection electrode frame.

2. The method of assembling a color cathode ray tube according to claim 1, wherein the dummy pins are arranged at positions separated by a predetermined distance along the axis of the color cathode ray tube from the panel pins in the state in which the panel is held, the panel inner surface is positioned opposing the main surface of the color selection electrode attached to the color selection electrode frame with a certain spacing, and the position of the main surface of the color selection electrode is adjusted with regard to the engaging holes on the basis of the measured values of the spacing between the main surface of the color selection electrode and the panel inner surface.

3. The method of assembling a color cathode ray tube according to claim 2, wherein the panel pins and the dummy pins are positioned with the predetermined distance along the axis by using a holding mechanism provided with panel-pin-engaging holes for engaging with the panel pins at a first end and the dummy pins at a second end.

4. The method of assembling a color cathode ray tube according to claim 3, wherein the holding mechanism comprises a detection element for measuring the spacing between the main surface of the color selection electrode and the panel inner surface.

5. The method of assembling a color cathode ray tube according to claim 1, wherein the supporting members are fixed by welding to predetermined positions of the color selection electrode frame white supporting the color selection electrode frame at the side having no color selection electrode.

6. The method of assembling a color cathode ray tube according to claim 1, wherein the supporting members are fixed by welding to the color selection electrode frame in a state in which the dummy pins are fixed at certain positions by a locking mechanism.

7. The method of assembling a color cathode ray tube according to claim 1, wherein the supporting members and the color selection electrode frame are held together with pressure applied during a welding of the supporting members and the color selection electrode frame.

8. The method of assembling a color cathode ray tube according to claim 1, wherein first distances from respective predetermined measurement positions to the panel inner surface are measured in a state in which the panel pins are fitted with panel-pin-fitting holes formed at a shifting mechanism;

the panel pins are released from the panel-pin-engaging part;

the engaging holes of the supporting members are engaged with the dummy pins provided to the shifting mechanism and at the same time the color selection electrode frame is arranged opposing the supporting members;

second distances from the respective predetermined measurement positions to the main surface of the color selection electrode attached to the color selection electrode frame are measured;

the position of the main surface of the color selection electrode frame is adjusted so that the second distances become equal to respective sums of the respective first distances and a specified value after canceling a distance along the axis of the color cathode ray tube between the position of the panel-pin-fitting holes during the measurement of the first distances and the position of the dummy pins during the measurement of the second distances; and the supporting members and the color selection electrode frame are welded together.

9. The method of assembling a color cathode ray tube according to claim 8, wherein the specified value is a Q value of the color cathode ray tube.

10. An apparatus for assembling a color cathode ray tube having a panel provided with a plurality of panel pins protruding from an inner surface of the panel, a plurality of supporting members provided with engaging holes respectively at first ends, and a color selection electrode frame attached with a color selection electrode, wherein second ends of the supporting members are fixed by welding respectively to the color selection electrode frame, and the engaging holes are engaged respectively with the panel pins, the apparatus comprising:

a panel-holding member for holding the panel;

dummy pins for engaging with the engaging holes of the supporting members; a frame-shifting mechanism for holding the color selection electrode frame and adjusting the position of the color selection electrode frame;

a measuring device for measuring an inner surface position of the panel held by the panel-holding member and also measuring a position of a main surface of the color selection electrode attached to the color selection electrode frame held by the frame-shifting mechanism; and a welding device for fixing by welding together the supporting members having the engaging holes engaged with the dummy pins and the color selection electrode frame held by the frame-shifting mechanism.

11. The apparatus for assembling a color cathode ray tube according to claim 10, further comprising a controller that obtains a measured value corresponding to a spacing between the main surface of the color selection electrode and the inner surface of the panel in the held state on the basis of the positional data measured by the measuring device, and drives the frame-shifting mechanism on the basis of the measured value so as to adjust the position of the main surface of the color selection electrode with respect to the engaging holes.

12. The apparatus for assembling a color cathode ray tube according to claim 10, wherein the panel-holding member holds the panel and at the same time the frame-shifting mechanism holds the color selection electrode frame so that the main surface of the color selection electrode opposes the inner surface of the panel with a spacing, the dummy pins are positioned with a predetermined distance from the panel pins of the panel held by the panel-holding member along the axis of the color cathode ray tube, and the measuring device measures a spacing between the inner surface of the panel held by the panel-holding member and the main surface of the color selection electrode attached to the color selection electrode frame held by the frame-shifting mechanism.

13. The apparatus for assembling a color cathode ray tube according to claim 12, wherein the frame-shifting mechanism has a structure for supporting the color selection electrode frame at the side not to be attached with the color selection electrode.

14. The apparatus for assembling a color cathode ray tube according to claim 10, further comprising a holding mechanism formed by integrating the panel-holding member and the dummy pins, wherein the holding mechanism is provided at one end with fitting holes for fitting with the panel pins so as to function as the panel-holding member and is provided with the dummy pins at the other end.

15. The apparatus for assembling a color cathode ray tube according to claim 14, wherein the measuring device is provided on the holding mechanism.

16. The apparatus for assembling a color cathode ray tube according to claim 10, further comprising a locking mechanism for fixing the position of the dummy pins.

17. The apparatus for assembling a color cathode ray tube according to claim 10, further comprising a device for applying pressure mutually to the supporting members and the color selection electrode frame so as to be held together.

18. The apparatus for assembling a color cathode ray tube according to claim 10, further comprising a shifting mechanism provided with the panel-holding member and the dummy pins, wherein the panel-holding member is composed of panel-pin-fitting holes for fitting with the panel pins so that the panel-holding member selectively holds the panel by an engagement with the panel-pin-fitting holes or the supporting members by an engagement with the dummy pins, the measuring device measures first distances from respective predetermined measurement positions to the panel inner surface in a state that panel pins are engaged with the panel-pin-fitting holes, and measures second distances from the respective predetermined measurement positions to the main surface of the color selection electrode attached to the color selection electrode frame in a state that the engaging holes of the supporting members are engaged with the dummy pins, and the position of the main surface of the color selection electrode is adjusted with respect to the engaging holes of the supporting members on the basis of the data of the first and second distances.

* * * * *